US008220701B2

(12) United States Patent
Fontaine et al.

(10) Patent No.: US 8,220,701 B2
(45) Date of Patent: Jul. 17, 2012

(54) CARTONS, PACKAGES, BLANKS, AND CONTAINERS HAVING DISPENSING AND OPENING FEATURES

(75) Inventors: Alan Fontaine, Louisville, CO (US); Norman L. Jesch, Golden, CO (US); Kelly R. Fitzwater, Lakewood, CO (US)

(73) Assignee: Graphic Packaging International, Inc., Marietta, GA (US)

( * ) Notice: Subject to any disclaimer, the term of this patent is extended or adjusted under 35 U.S.C. 154(b) by 85 days.

(21) Appl. No.: 12/700,108

(22) Filed: Feb. 4, 2010

(65) Prior Publication Data

US 2010/0193575 A1 Aug. 5, 2010

Related U.S. Application Data

(63) Continuation of application No. PCT/US2008/072957, filed on Aug. 13, 2008.

(60) Provisional application No. 60/964,751, filed on Aug. 14, 2007, provisional application No. 60/995,367, filed on Sep. 26, 2007.

(51) Int. Cl.
*B65D 5/56* (2006.01)
*B65D 43/02* (2006.01)
*B65D 43/16* (2006.01)

(52) U.S. Cl. ..... 229/117.32; 229/125.09; 229/125.14; 229/125.17; 229/125.25

(58) Field of Classification Search ..... 229/117.27, 229/117.32, 117.33, 117.34, 125.04, 125.09, 229/125.14, 125.17, 125.25, 164.2, 132, 229/136

See application file for complete search history.

(56) References Cited

U.S. PATENT DOCUMENTS

| | | | | | |
|---|---|---|---|---|---|
| 1,140,288 | A | * | 5/1915 | Robinson | 229/132 |
| 2,493,337 | A | * | 1/1950 | Buttery | 229/117.32 |
| 2,998,180 | A | * | 8/1961 | Dehoney, Jr. | 229/136 |
| 3,083,889 | A | * | 4/1963 | Christensson | 229/117.33 |
| 3,110,436 | A | * | 11/1963 | Wagner | 229/125.14 |
| 3,269,635 | A | | 8/1966 | Bergstein et al. | |
| 3,878,771 | A | | 4/1975 | Malcolm | |
| 3,883,068 | A | | 5/1975 | Silver | |
| 3,912,156 | A | | 10/1975 | May | |
| 3,944,127 | A | * | 3/1976 | Bruke et al. | 229/125.09 |
| 4,063,679 | A | | 12/1977 | Henry | |
| 4,099,665 | A | * | 7/1978 | Bergstein | 229/117.34 |
| 4,121,753 | A | * | 10/1978 | Westfall | 229/132 |

(Continued)

FOREIGN PATENT DOCUMENTS

EP 09430548 9/1999

OTHER PUBLICATIONS

International Search Report and Written Opinion—PCT/US2008/072957.

(Continued)

*Primary Examiner* — Gary Elkins
(74) *Attorney, Agent, or Firm* — Womble Carlyle Sandridge & Rice, LLP

(57) ABSTRACT

A carton, package, or container formed from a blank and that include a film or other moisture resistant lining applied thereto are described. The film is adhered to the inside panels of the carton, package, or container. The carton, package, or container are capable of receiving a lid and contents therein when formed. The cartons, packages, and containers include reclosable features and may be sealed against moisture and other environmental factors.

50 Claims, 40 Drawing Sheets

U.S. PATENT DOCUMENTS

| | | | | | |
|---|---|---|---|---|---|
| 4,169,540 | A | * | 10/1979 | Larsson et al. | 229/117.33 |
| 4,380,447 | A | * | 4/1983 | VanderLugt, Jr. | 229/125.17 |
| 4,495,209 | A | * | 1/1985 | Whiteside | 229/125.14 |
| 4,499,998 | A | | 2/1985 | Carlson | |
| 4,736,870 | A | * | 4/1988 | Christensson | 229/117.32 |
| 4,997,104 | A | * | 3/1991 | Pohl | 229/117.34 |
| 5,083,671 | A | | 1/1992 | Hayes | |
| 5,106,015 | A | | 4/1992 | Vlasaty et al. | |
| 5,211,305 | A | * | 5/1993 | Horton | 229/117.27 |
| 5,350,110 | A | | 9/1994 | Will | |
| 5,848,749 | A | | 12/1998 | Ljungstrom | |
| 6,227,367 | B1 | | 5/2001 | Harrelson et al. | |
| 6,364,199 | B1 | | 4/2002 | Rose | |
| 6,390,358 | B1 | | 5/2002 | Stewart et al. | |
| 6,688,515 | B1 | | 2/2004 | Huffman et al. | |
| 6,957,763 | B2 | | 10/2005 | Huffman et al. | |
| 7,665,653 | B2 | | 2/2010 | Fitzwater | |
| 2003/0197051 | A1 | * | 10/2003 | Muise et al. | 229/117.32 |
| 2004/0164134 | A1 | * | 8/2004 | Gong et al. | 229/132 |
| 2006/0255106 | A1 | | 11/2006 | Green | |

OTHER PUBLICATIONS

Supplemental European Search Report for corresponding European Application No. 08 79 7741 dated Sep. 6, 2011.

* cited by examiner

CARTONS, PACKAGES, BLANKS, AND CONTAINERS HAVING DISPENSING AND OPENING FEATURES

PRIORITY

This application is a continuation of International Application No. PCT/US2008/072957, filed Aug. 13, 2008, entitled "Cartons, Packages, Blanks, and Containers Having Dispensing and Opening Features," which designates the United States of America and which claims the benefit under 35 U.S.C. §119(e) of U.S. Provisional Application No. 60/964,751, filed Aug. 14, 2007, and 60/995,367, filed Sep. 26, 2007.

BACKGROUND

This invention relates to cartons or sleeves used to store or carry products. The cartons or sleeves are formed from blanks and generally surround or hold at least a portion of the product or articles placed therein.

SUMMARY

The entire disclosures of International Application No. PCT/US2008/072957 and U.S. Provisional Application Nos. 60/964,751 and 60/995,367 are hereby incorporated by reference in their entirety as though fully set forth herein.

In one aspect, the present invention provides a convenient, moisture barrier, and leak resistant, package with additional features. In another aspect, the present invention provides a paperboard structure and a formed lid to form a barrier carton. Barriers can include rimmed tray(s), sealed membrane(s), and/or IntegraPak™ liner(s), with the carton and/or barriers formed in oval, round, or other shapes. In another aspect, the present invention provides a two piece barrier paperboard package that incorporates an integrated lid with convenience features for products, such as moisture, oxygen, and/or grease barriers. While several prior designs include a one-piece paperboard design, a stand-up pouch, or a tray with a film membrane heat sealed over the rim, the carton of the present invention can integrate and/or accommodate several types of barriers and lids. The carton of the present invention can be used, for example, for any material that could be poured out of a container, such as materials that may require a moisture barrier, such as spices, sugar, other sweeteners, coffee, tea leaves or other things.

In one aspect, the invention includes a carton with a moisture barrier, the carton having a top end and a bottom end. The carton is formed from a blank having a front face and a back face, and includes a first side connected along a first fold line to a second side, the second side connected along a second fold line to a third side, and the third side connected along a third fold line to a fourth side. The blank also includes a first side end panel connected along a lower transverse fold line to the bottom end of the first side, a second side end panel connected along the lower transverse fold line to the bottom end of the second side, a third side end panel connected along the lower transverse fold line to the bottom end of the third side, and a fourth side end panel connected along the lower transverse fold line to the bottom end of the fourth side.

A film can be adhered to the back face of the blank along at least either the first side, second side, third side, or fourth side of the blank, but not adhered to the first end panel, the second end panel, the third end panel, or the fourth end panel. The film being moisture resistant. The carton can be sized to receive a removable lid at the top end. In one option, the film can extend along an extension beyond the top end of the blank. Further, the film can be folded to close the contents in the carton to form a package. Alternatively, the film can be rolled to close the contents within the carton to form a package. Alternatively still, the film can be sealed along the top of the carton to form a seal capable of being punctured.

Further, the lid can have an open portion and a closed portion, with at least a first portion of the seal covered by the closed portion of the lid in a closed configuration, and the first portion of the seal exposed by the open portion of the lid in an open configuration. Alternatively, the lid can have an open portion and a closed portion, with at least a first portion of the seal covered by the closed portion of the lid in a closed configuration and exposed by the open portion of the lid in an open configuration. As a further alternative, the lid can have a closed portion and portion capable of being hinged to create an opening in the carton. In one such embodiment, the opening can be formed in a corner of the carton.

The lid also can be formed in a variety of shapes or configurations, such as a triangular configuration, a rectangular configuration, a circular configuration, an L-shaped configuration, or other shapes or configurations. In another embodiment, the opening can be formed entirely in either the first side, the second side, the third side, or the fourth side. In yet another embodiment, the lid can cover the top end of the carton and the hinged portion can be disposed entirely within the lid. In still another embodiment, the opening can be formed in at least two of the first side, the second side, the third side, and the fourth side. In another embodiment, the lid can cover the top end of the carton and includes hinged closure flaps capable of engaging projections on the carton. The carton further can include a bag disposed in the carton beneath the lid, and can include a handle attached thereto.

In another aspect, the invention includes a package with a moisture barrier, the package including a top end and a bottom end. The package is formed from a carton blank having a front face and a back face and generally includes a first side connected along a first fold line to a second side, the second side connected along a second fold line to a third side, and the third side connected along a third fold line to a fourth side. The blank also includes a first side end panel connected along a lower transverse fold line to the bottom end of the first side, a second side end panel connected along the lower transverse fold line to the bottom end of the second side, a third side end panel connected along the lower transverse fold line to the bottom end of the third side, and a fourth side end panel connected along the lower transverse fold line to the bottom end of the fourth side.

The blank also can include a film adhered to the back face of the blank along at least either the first side, second side, third side, or fourth side, but not adhered to the first end panel, the second end panel, the third end panel, or the fourth end panel. The film generally can be a moisture or vapor resistant material. The package further will be sized to receive a removable lid at the top end. In one option, the film can extend an extension beyond the top end of the blank. Further, the film can be folded to enclose the contents within the carton. Alternatively, the film can be rolled to enclose the contents within the carton. Alternatively still, the film can be sealed along the top of the package to form a seal capable of being punctured. Further, the lid can have an open portion and a closed portion, with at least a first portion of the seal covered by the closed portion of the lid in a closed configuration and exposed by the open portion of the lid in an open configuration. As a further alternative, the lid can have a closed portion and a portion capable of being hinged to create an opening in the package. In one such embodiment, the opening can be formed in a corner of the package.

The lid also can be formed in a variety of shapes or configurations, such as a triangular configuration, a rectangular configuration, a circular configuration, an L-shaped configuration, or other shapes or configurations. In a further embodiment, the opening of the package can be formed entirely in either the first side, the second side, the third side, or the fourth side thereof. In yet another embodiment, the lid can cover the top end of the carton and the hinged portion can be disposed entirely within the lid. In still another embodiment, the opening in the package can be formed in at least two of the first, second, third, and fourth sides of the package. In yet another embodiment, the lid can cover the top end of the package and can include hinged closure flaps capable of engaging projections on the package. The package additionally can include a bag disposed in the package beneath the lid, and also can include a handle attached thereto.

In another aspect, the invention includes a blank for forming a carton, having a first side connected along a first fold line to a second side, the second side connected along a second fold line to a third side, and the third side connected along a third fold line to a fourth side. The blank has a top end and a bottom end, and a front face and a back face. The blank also includes a first side end panel connected along a lower transverse fold line to the bottom end of the first side, a second side end panel connected along the lower transverse fold line to the bottom end of the second side, a third side end panel connected along the lower transverse fold line to the bottom end of the third side, and a fourth side end panel connected along the lower transverse fold line to the bottom end of the fourth side. A film extends beyond the top end of the blank and is adhered to the back face along at least either the first side, second side, third side, or fourth side of the blank, but typically is not adhered to the first end panel, the second end panel, the third end panel, or the fourth end panel. An adhesive panel can be attached along a fourth fold line to the fourth side, and/or an adhesive can be added to the blank along the adhesive panel and portions of at least either the first side end panel, the second side end panel, the third side end panel, or the fourth side end panel.

In yet another aspect, the invention includes a blank for forming a carton. The blank has a first side connected along a first fold line to a second side, the second side connected along a second fold line to a third side, the third side connected along a third fold line to a fourth side, and the fourth side being connected to an adhesive panel. The blank has a top end and a bottom end, and a front face and a back face. The blank also generally has a first side end panel connected along a lower transverse fold line to bottom end of the first side, a second side end panel connected along the lower transverse fold line to the bottom end of the second side, a third side end panel connected along the lower transverse fold line to the bottom end of the third side, a fourth side end panel connected along the lower transverse fold line to the bottom end of the fourth side. A film can be adhered to the back face along at least either the first side, second side, third side, or fourth side of the blank, but typically is not adhered to the first end panel, the second end panel, the third end panel, or the fourth end panel, with the film extending beyond the top end of the blank. A fifth side end panel can be connected along the lower transverse fold line to the bottom end of the adhesive panel. An adhesive can be added to the blank along the adhesive panel and portions of at least either the first side end panel, the second side end panel, the third side end panel, the fourth side end panel, or the fifth side end panel.

The foregoing and various other features, aspects, and advantages of the invention will become more apparent upon review of the detailed description of the embodiments set forth below when taken in conjunction with the accompanying drawing figures, which are briefly described as follows.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

The present embodiments are addressed to dispensing cartons, packages and containers. The cartons and packages can have, for example, barrier or liner films mounted to their interior surfaces. According to one aspect of the present invention, a barrier film is attached to the interior surface of a blank. The barrier film is then sealed and the carton is erected from the blank. Dispensing features can be mounted to the cartons, and/or incorporated into the cartons. The cartons can be used, for example, to accommodate products that require moisture, oxygen, and/or grease barriers, etc. The cartons and packages can also incorporate several types of barriers and/or lids.

Briefly described, the present invention is directed to cartons. In this specification, the terms "side," and "end" are used for ease of description are not intended to limit the scope of the invention or to imply relative sizes or orientations of panels, flaps, or other parts of the cartons, packages, and/or containers.

Figure 1:
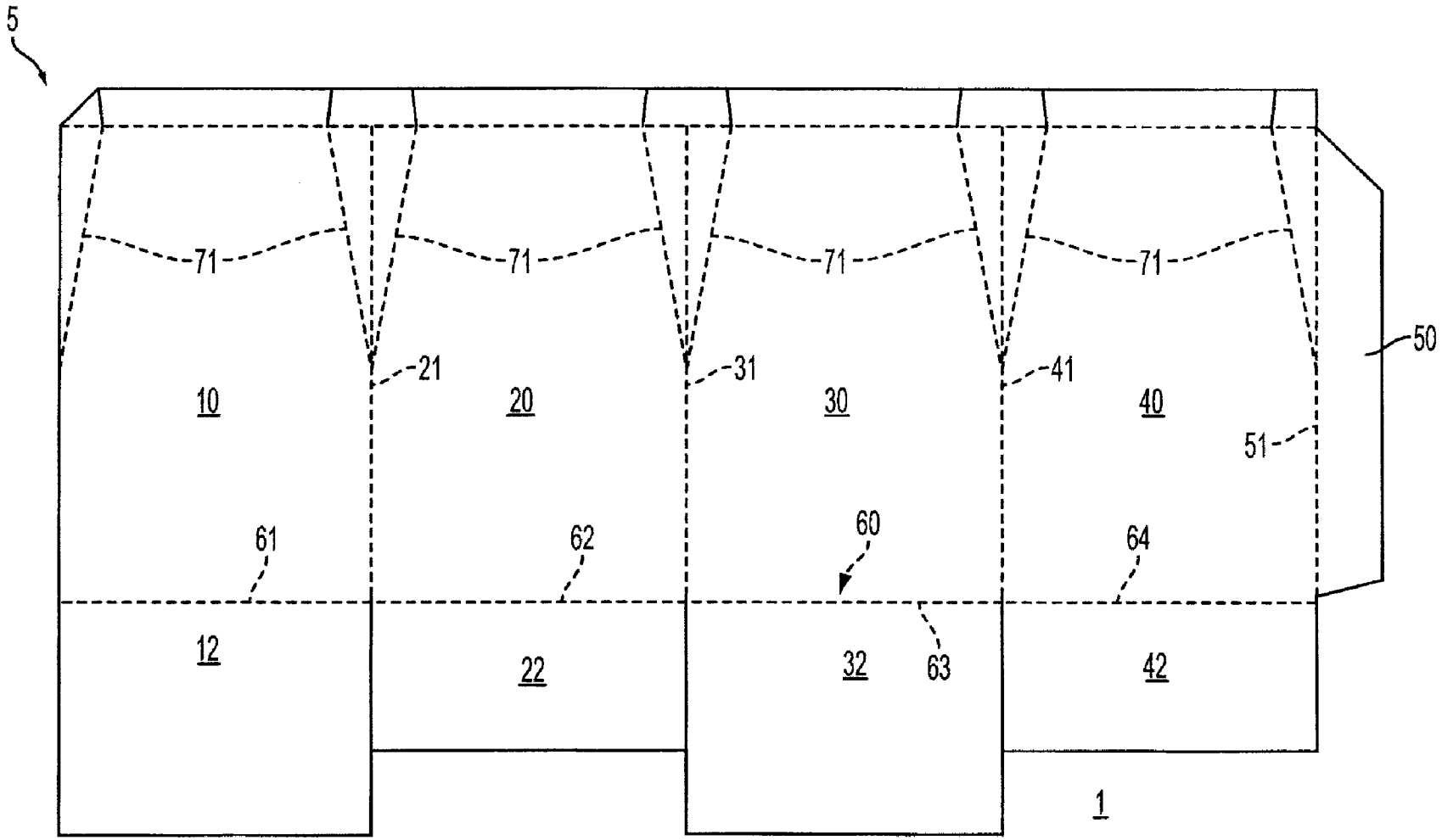
FIG. 1 is a plan view of a blank from which a package according to a first embodiment of the invention can be constructed.
Figure 2:
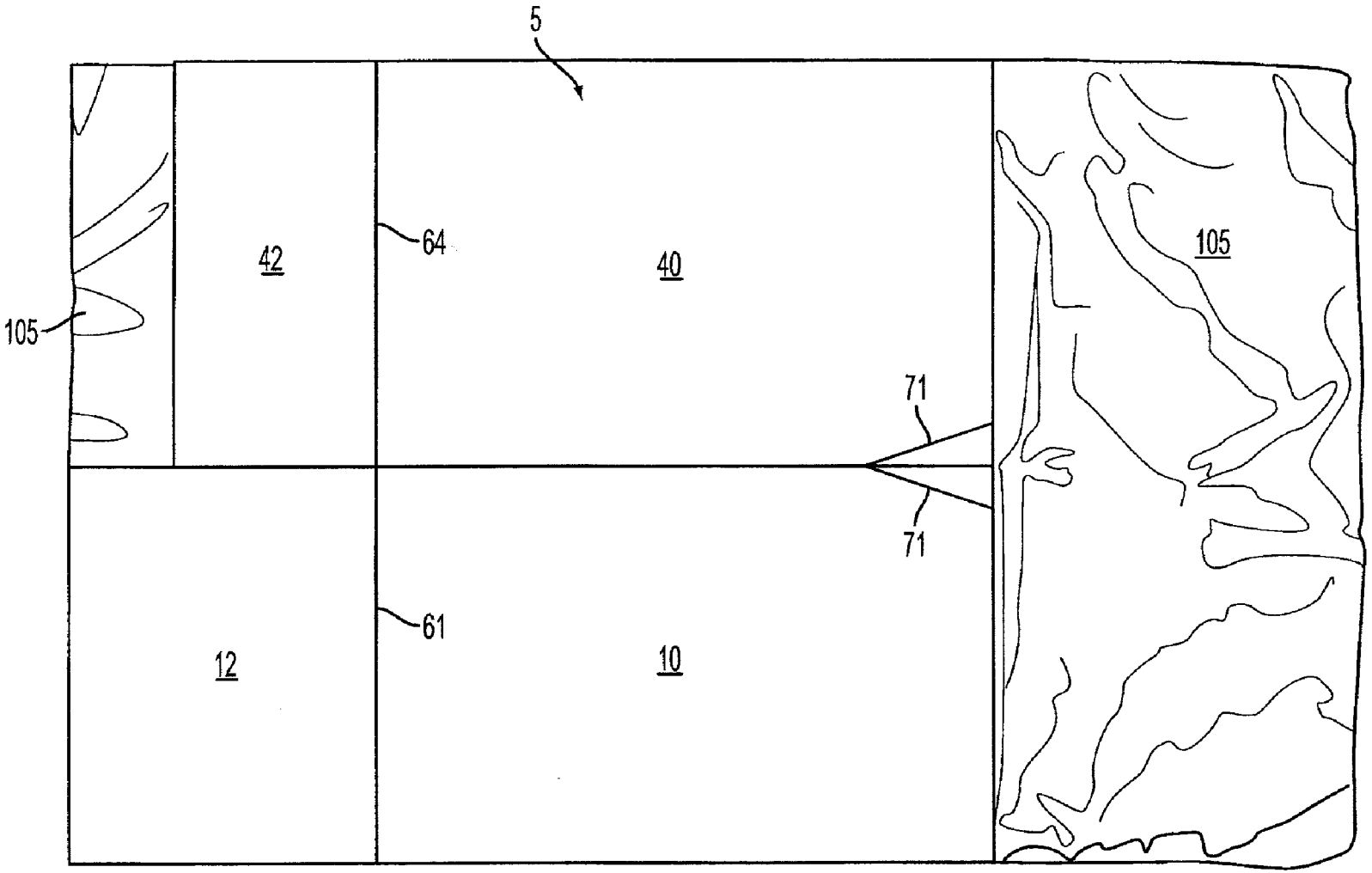
FIG. 2 shows two side panels during an erection step of the package according to the first embodiment.
Figure 3:
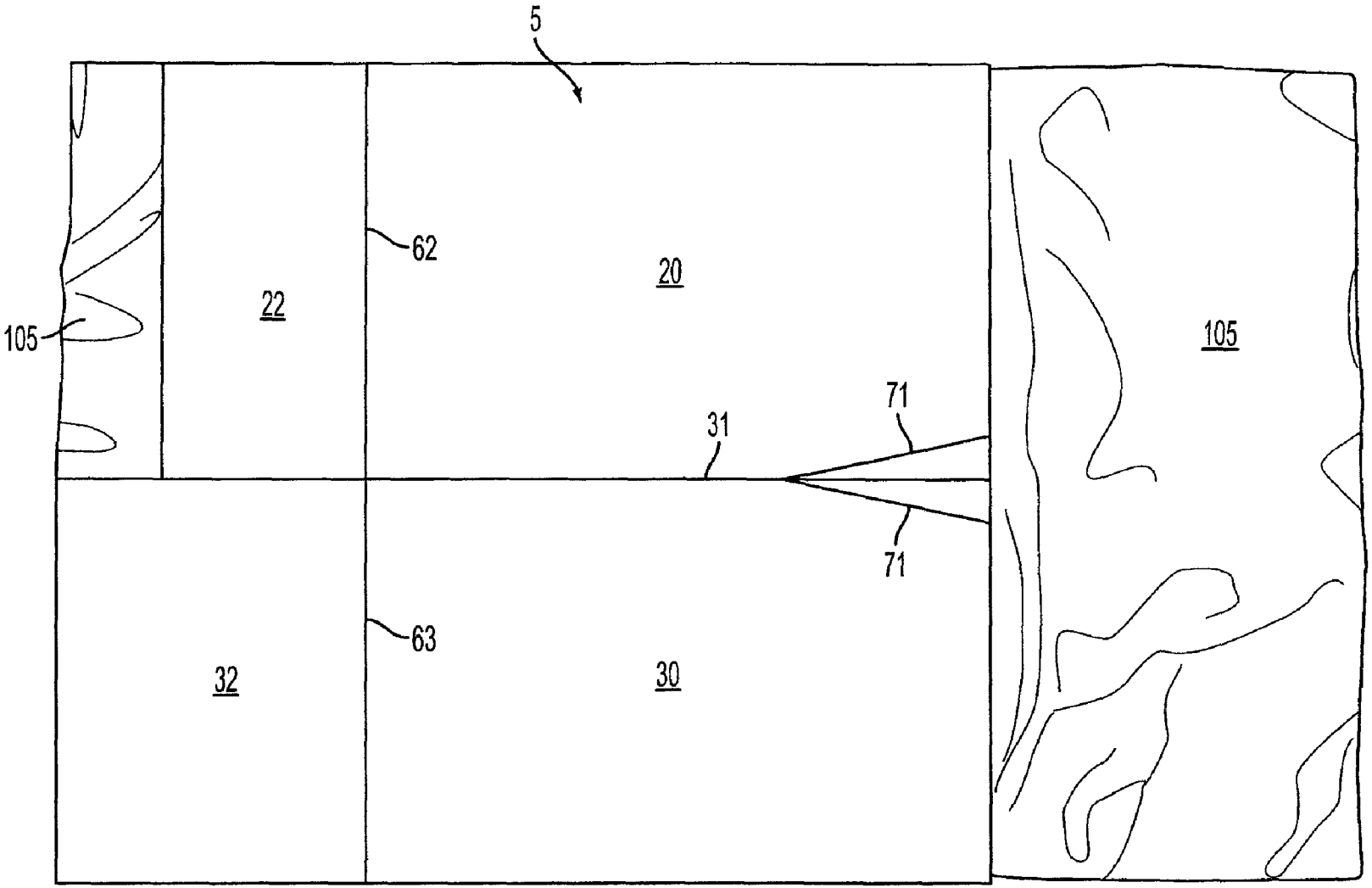
FIG. 3 shows two other side panels during an erection step of the package according to the first embodiment.

FIG. 1 is a plan view of a blank 5 used to form a package according to a first embodiment of the invention. FIGS. 2 and 3 each show two different panels during erection of a package or carton from blank 5 with a barrier or liner film 105 applied thereto. The blank 5 and a barrier film 105 applied thereto are used to construct a package 200 (FIG. 7) according to the first embodiment of the invention. In the illustrated exemplary embodiment, the blank 5 generally is constructed from solid unbleached sulfate (SUS) board, but other materials also can be used.

Referring to FIG. 1, the blank 5 includes a first side panel 10, a second side panel 20 foldably connected to the first side panel 10 along a fold line 21, a third side panel 30 foldably connected to the second side panel 20 along a fold line 31, and a fourth side panel 40 foldably connected to the third side panel 30 along a fold line 41. An adhesive panel 50 also may be foldably connected to the fourth side panel 40 along a fold line 51. Four bottom panels or end flaps are formed in a first or lower marginal area or periphery 1 of the blank 5, including a first end flap 12, a second end flap 22, a third end flap 32, and a fourth end flap 42. The end flaps 12, 22, 32, 42 together comprise a closure for one end of the erected package 200, as discussed further below. The end flaps 12, 22, 32, 42 may be foldably connected along a single fold line 60 in one embodiment or the end flaps 12, 22, 32, 42 may be foldably connected along individual panel separating fold lines 61, 62, 63, 64, respectively, in another embodiment. Fold lines 61, 62, 63, and 64 can be disposed along the same linear path or can be disposed at differing heights from the periphery 1 of the blank 5. Further, end flaps 12, 22, 32, 42 may extend at differing lengths away from fold line 60 or fold lines 61, 62, 63, 64. Further, the panels 10, 20, 30, 40, 50 can include folding assist features such as diagonal fold lines 71 at the upper portions thereof. These folding assist features can be formed at any distance or angle as needed to assist in folding the blank into a carton or package configuration, such as being formed at an angle of about ±12 degrees, such as extending at ±11.8 degrees along the fold lines at the top of the blank with the spacing/distances being variable, depending on the size of the blank.

The blank 5 and its panels, flaps, and lines can be formed of any size and configuration as desired. For exemplary purposes only, and not to limit the scope of the invention, the blank 5 shown in FIG. 1 can have an overall length of about ±17 inches, such as ±16.669 inches, and can have an overall width of about ±10 inches, such as ±9.515 inches. Panel 10 can have a width of about 4 inches, such as ±3.945 inches, panel 20 can have a width of about ±4 inches, such as ±3.969 inches, panel 30 can have a width of about ±4 inches, such as ±3.969 inches, panel 40 can have a width of about ±4 inches, such as ±3.969 inches, and adhesive panel 50 can have a width of about ±4 inches, such as ±0.818 inches. Panels 10, 20, 30, 40, 50 can have a width of up to about ±6 inches, flaps 12 and 32 can have a width of up to about ±3 inches, such as at ±2.984 inches, and flaps 22 and 42 can have a width of up to about ±2 inches, such as at ±1.984 inches. The tops of panels 10, 20, 30, and 40 can extend up to about ±0.5 inch above the end of the diagonal fold lines 71. The exemplary spacing/distances being variable, depending on the size of the blank. The present disclosure incorporates by reference U.S. Pat. No. 6,854,639, which is commonly assigned, for all that is disclosed therein.

Referring to FIGS. 2 and 3, the barrier film 105 is affixed, adhered or otherwise applied to an interior surface of the blank 5 that will become an interior surface of the erected package 200. The barrier film 105 can be secured to the surface of the blank 5 by, for example, glue, other adhesives, lamination, and by other means. As shown in FIGS. 2 and 3, the barrier film 105 may extend beyond the edges of the blank 5 at both ends of the blank 5. The barrier film 105 can be formed from, for example, a vapor or liquid-impervious moisture barrier or other leak resistant material.

Figure 4:
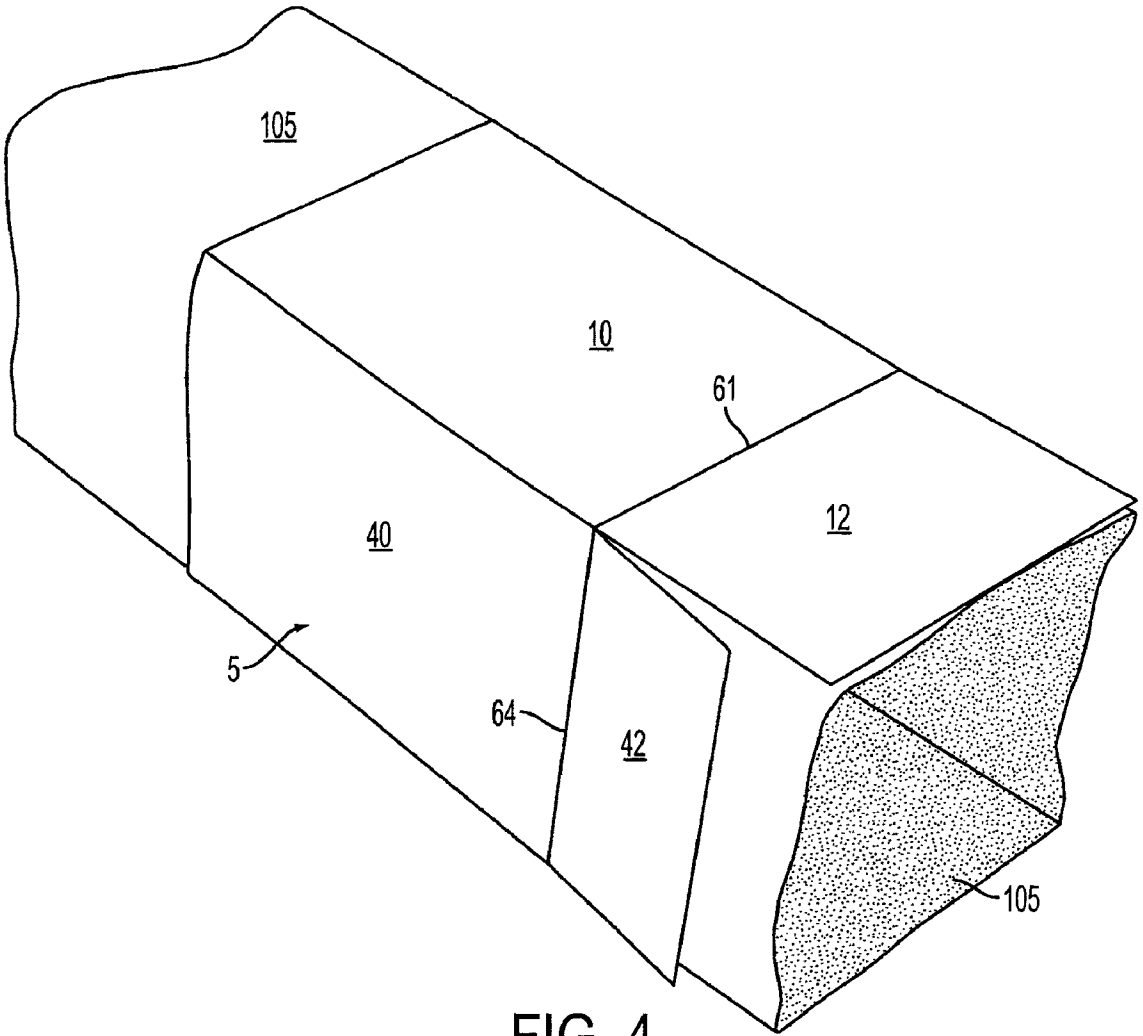
FIG. 4 shows an erection step of the package according to the first embodiment with the blank formed in a sleeve configuration.

The package 200 may be erected from the blank 5 and barrier film 105 by folding the blank flat or substantially flat about the transverse fold lines 21, 41, and gluing or otherwise adhering the exterior side of the adhesive flap 50 to the interior side of the first side panel 10. At this time, one end of the barrier film may optionally be sealed. The side panels 10, 20, 30, 40 may be then opened or set up to form a generally tubular sleeve, as shown in FIG. 4. The barrier film 105 also opens as the blank 5 is opened.

Figure 5:
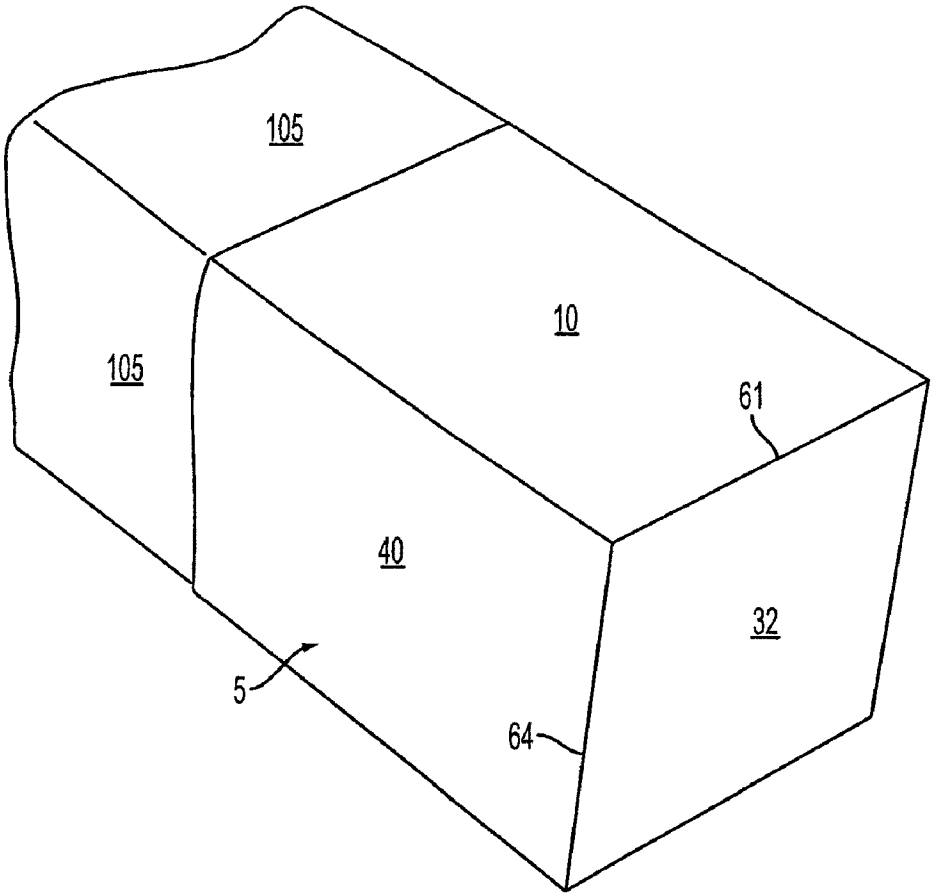
FIG. 5 shows the package according to the first embodiment with the base being closed.
Figure 6:
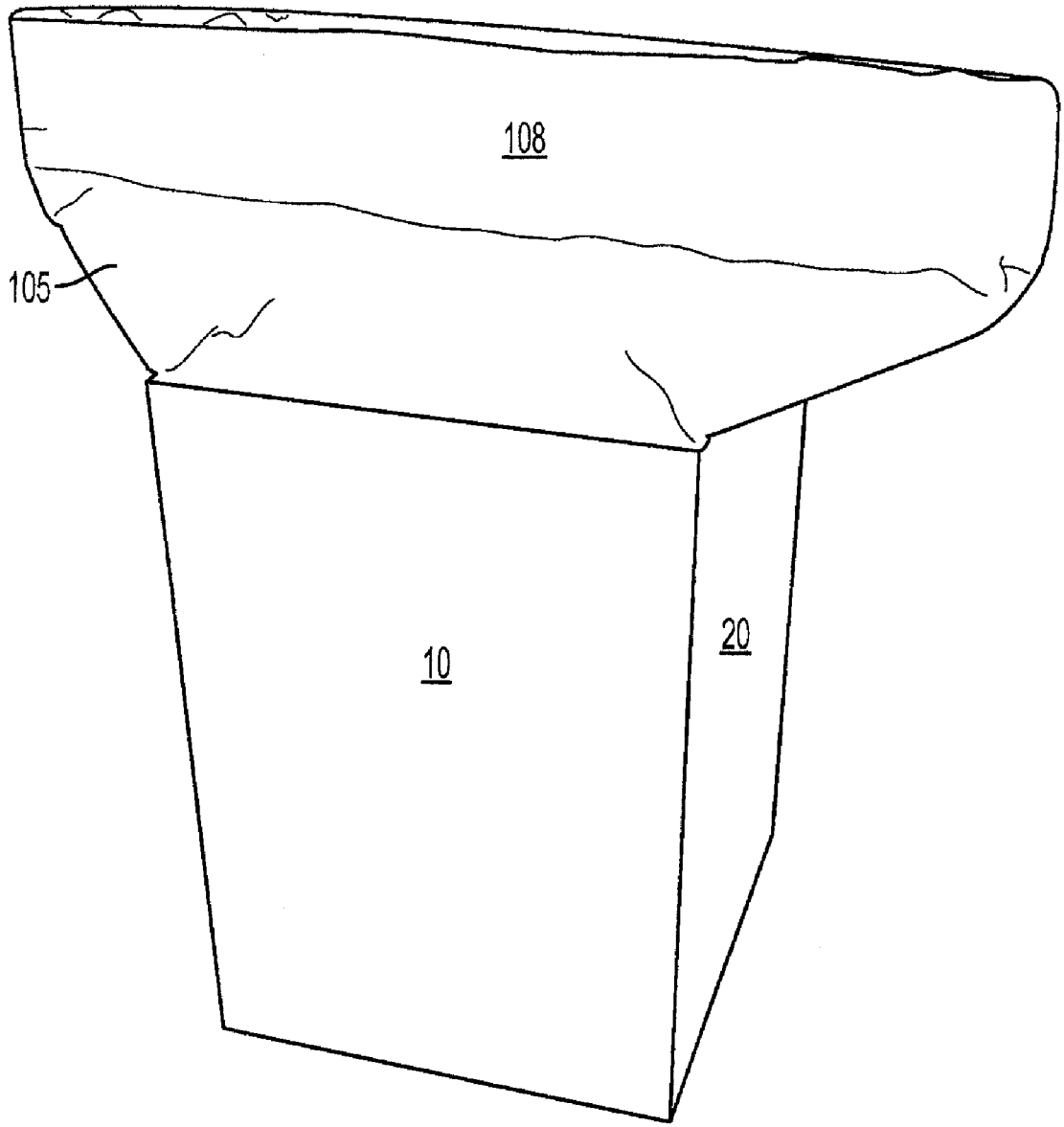
FIG. 6 shows the package according to the first embodiment with the top being closed at the liner.

Referring to FIGS. 5 and 6, if the first or bottom end of the barrier film 105 is not yet sealed, it can be sealed after the tubular sleeve has been opened as shown in FIG. 4. The first or bottom end of the generally tubular sleeve may then be closed as shown in FIG. 5, for example, by folding and adhering the end flaps 12, 22, 32, 42 of the blank 5.

As shown in FIG. 6, a top, open end of the barrier film 105 can be closed to form a seal 108 at the top end of the film. Dispensable articles, liquids or other product (not illustrated), for example, may be loaded into the sleeve in a conventional manner at any time before one or both ends of the barrier film 105 within the sleeve are sealed. The ends of the barrier film 105 can be sealed by, for example, heat sealing, hot or cold glue processes, and applied coatings that form seals in response to heat, pressure, or other closure means.

Figure 7:
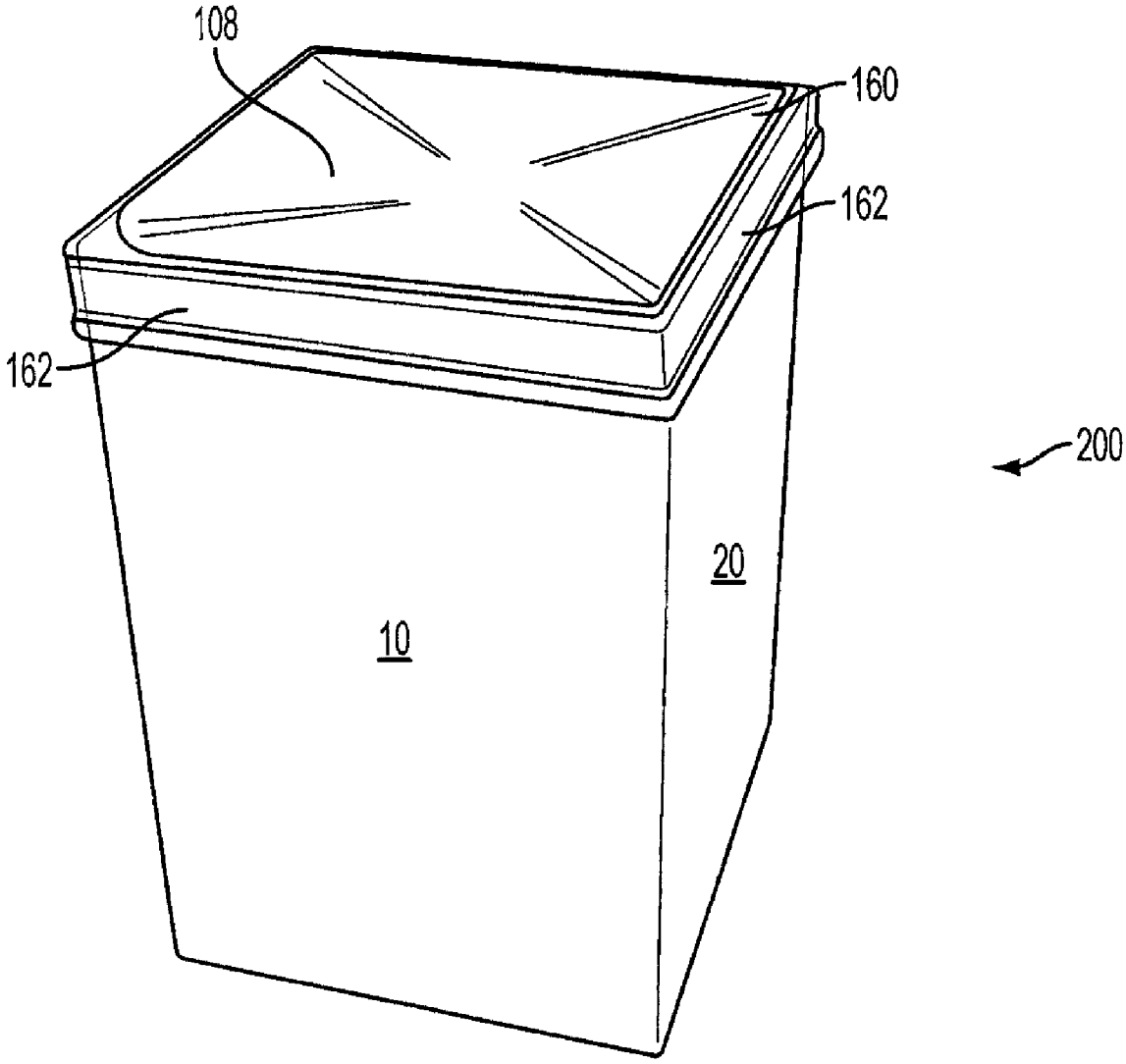
FIG. 7 shows the package according to the first embodiment with a lid on the top.

Referring to FIG. 7, a cover 160 can be mounted to the top of the erected blank to complete erection of the package 200. The package 200 can have, for example, a generally parallelepipedal shape. To facilitate mounting of the cover 160 to the package, the seal 108 of the barrier film 105 can be folded into the relatively compact form shown in FIG. 7. The cover 160 can have a snug, interference fit with the top of the package. Indentations 162 also can be included in the cover 160 that press inwardly on the sides of the package and more securely the cover 160 in place. The cover 160 can be made from plastics, for example, such as polypropylene, polyethylene, polyethylene terephthalate, nylon, etc. by injection molding, thermoforming, or die cutting, etc.

In order to remove the contents of the package 200, the cover 160 can be removed and the seal 108 breached. After dispensing the package contents, the cover 160 can be replaced on the package 200 to enclose the remaining contents.

The partially erected blank article illustrated in FIGS. 2 and 3 is formed from blank 5. In the partially erected blank article, the barrier film 105 may be sealed along one end edge. In the flattened configuration, the article occupies minimal space in a shipping or storage container, on a display shelf, or in a potential end user's possession.

Figure 8:
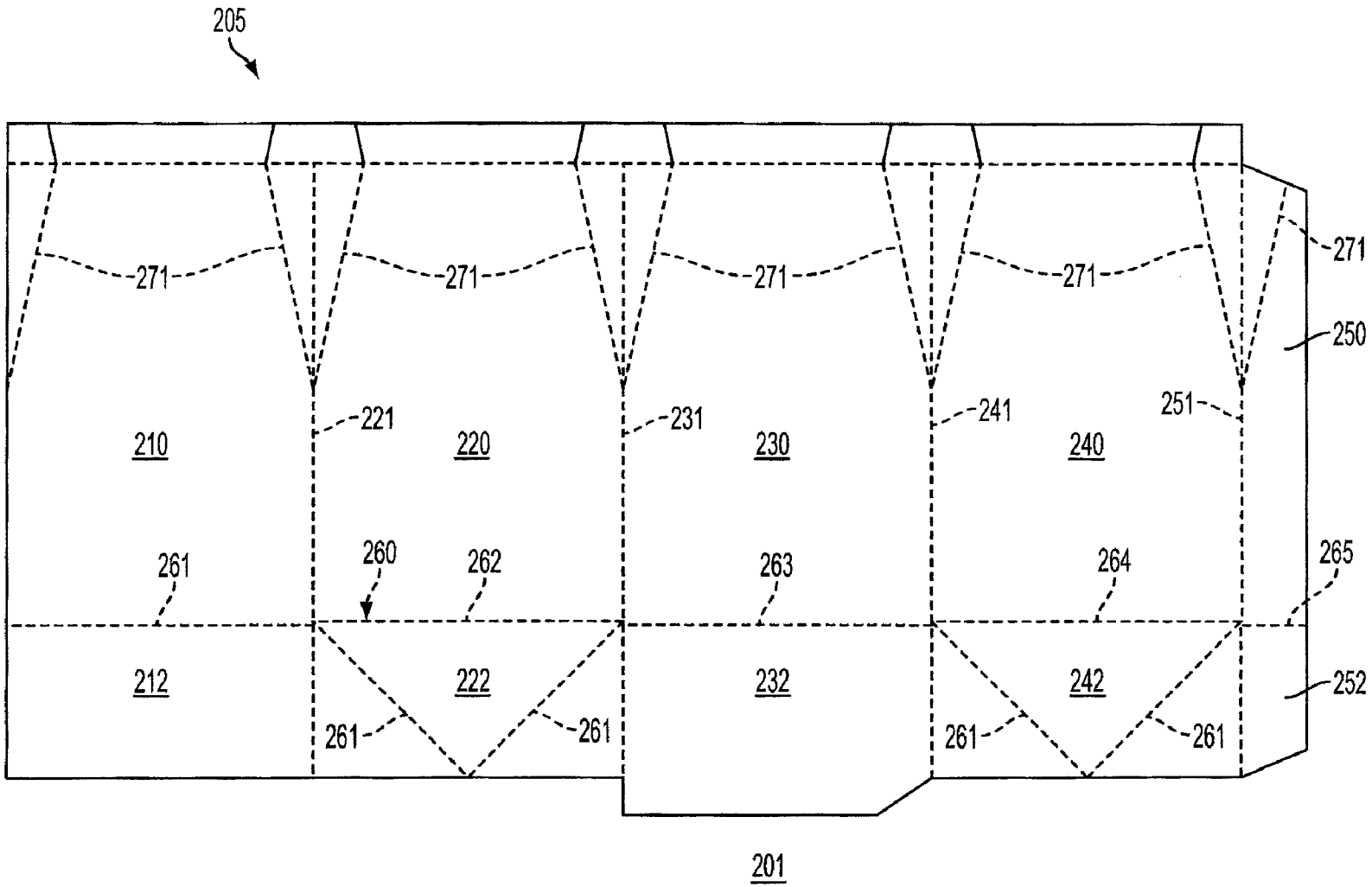
FIG. 8 is a plan view of a blank from which a package according to a second embodiment of the invention can be constructed.

FIG. 8 is a plan view of a blank 205 used to construct a generally parallelepipedal package 400 (illustrated in FIG. 9) according to a second embodiment of the invention. The blank 205 includes a first side panel 210, a second side panel 220 foldably connected to the first side panel 210 along a fold line 221, a third side panel 230 foldably connected to the second side panel 220 along a fold line 231, and a fourth side panel 240 foldably connected to the third side panel 230 along a fold line 241. An adhesive panel 250 may be foldably connected to the fourth side panel 240 along a fold line 251. Four bottom end panels or flaps are formed in a first or lower marginal area or periphery 201 of the blank 205, including a first end flap 212, a second end flap 222, a third end flap 232, and a fourth end flap 242. Unlike the embodiment shown in FIG. 1, blank 205 includes a end panel or flap 252 in the first or lower marginal area attached at adhesive panel 250. The end flaps 212, 222, 232, 242, 252 together comprise a closure for one end of the erected package 400, as discussed further below. The end flaps 212, 222, 232, 242, 252 may be foldably connected along a fold line 260 in one embodiment or the end flap 212, 222, 232, 242 may be foldably connected along fold lines 261, 262, 263, 264, 265 respectively, in another embodiment. Fold lines 261, 262, 263, 264, 265 can be disposed along the same linear path or can be disposed at differing heights from the periphery 201 of the blank 205. Further, end flaps 212, 222, 232, 242, 252 may extend at differing lengths from fold line 260 or fold lines 261, 262, 263, 264, 265. The end flaps 212, 222, 232, 242, 252 also can include fold assist features, such as shown in end flaps 222 and 242 as additional fold lines 261 extending in a diagonal configuration disposed at angles, such as at 45-degrees shown in FIG. 8.

The blank 205 and its panels, flaps, and lines can be formed of any size and configuration as desired. For exemplary purposes only, and not to limit the scope of the invention, the blank 205 shown in FIG. 8 can have an overall length of about ±17 inches, such as ±16.669 inches, and can have an overall width of about ±10 inches, such as ±8 63/64 inches. Panel 210 can have a width of about ±4 inches, such as ±3.945 inches, panel 220 can have a width of about ±4 inches, such as ±3 31/32 inches, panel 230 can have a width of about ±4 inches, such as ±3 31/32 inches, panel 240 can have a width of about ±4 inches, such as ±3 31/32 inches, and adhesive panel 250 can have a width of about +4 inches, such as +0.818 inches. Panels 210, 220, 230, 240, 250 can have a width of up to about ±7 inches, such as +6 1/32 inches, flap 232 can have a width of up to about ±3 inches, such as at +2 29/64 inches, and flaps 212, 222, and 242 can have a width of up to about ±2 inches, such as at ±1 61/64 inches. The tops of panels 210, 220, 230, and 240 can extend up to about ±½ inch above the end of the diagonal fold lines 271. The exemplary spacing/distances being variable, depending on the size of the blank.

If desired, a barrier film (not shown) may be affixed, adhered or otherwise applied to an interior surface of the blank 205. The barrier film can be secured to the surface of the blank 205 by, for example, glue, or other adhesives, lamination, and by other means.

The package 200 may be erected from the blank 205 by gluing or otherwise adhering the adhesive flap 250 to the inner side of the panel 210 so that the panels 210, 220, 230, 240 may be opened or set up to form a generally tubular sleeve. Further, the panels 210, 220, 230, 240 can include folding assist features such as diagonal fold lines 271 at the upper portions thereof. These folding assist features can be formed at any distance or angle as needed to assist in folding the blank into a carton or package configuration, such as being formed at up to about ±3 inches from either side of the fold line, for example, at 0.625 inches from either or both sides of the fold lines at the top of the blank with the spacing/distances being variable, depending on the size of the blank.

The first or bottom end of the generally tubular sleeve may be closed, for example, by folding and adhering the end flaps 212, 222, 232, 242, 252. If present, the barrier film can be sealed at its upper and lower ends prior to closing the bottom end of the tubular sleeve. Dispensable articles, liquids or other product, for example, may be loaded into the sleeve in a conventional manner at any time before one or both ends of the barrier film are sealed.

Figure 9:
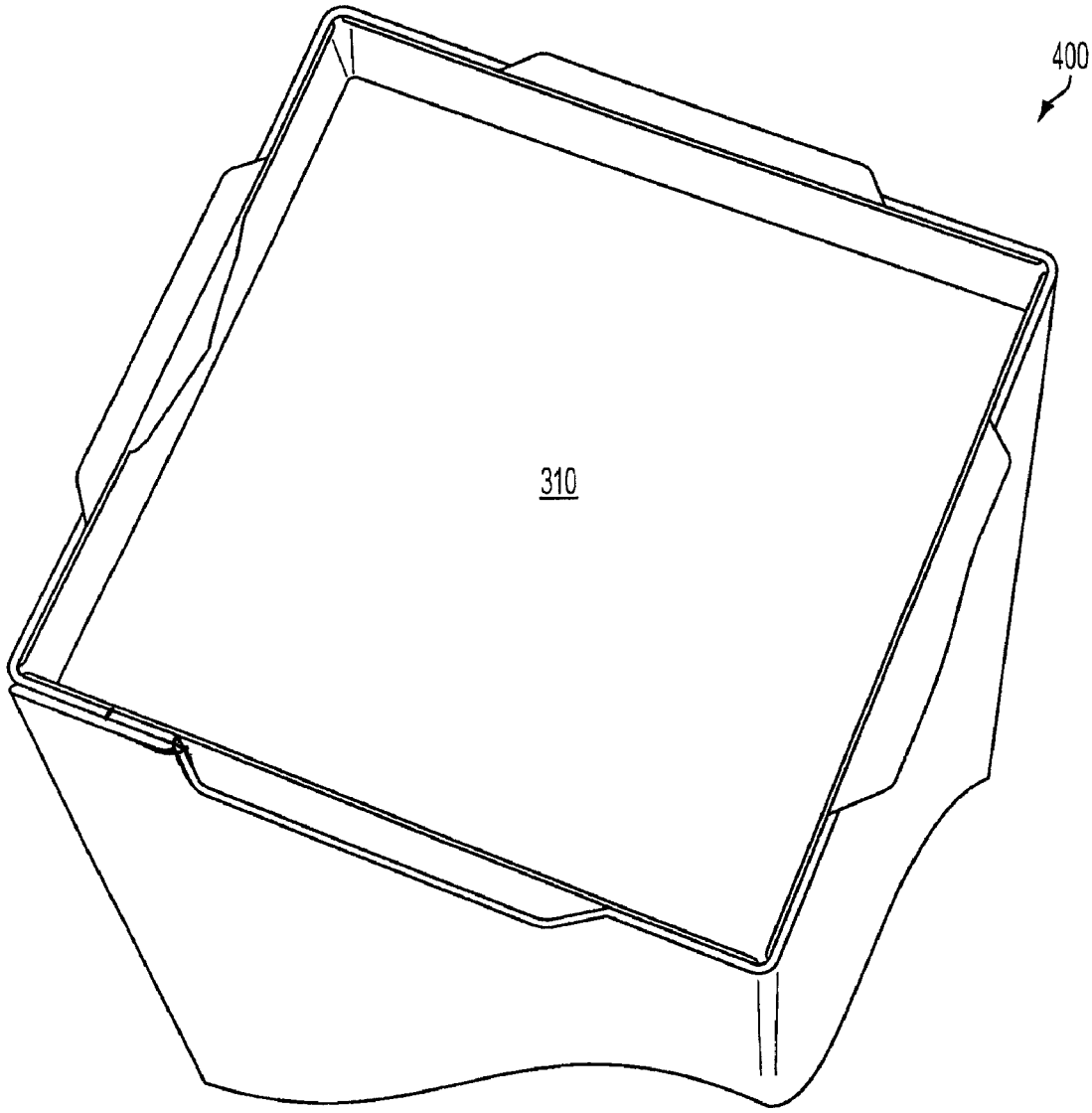
FIG. 9 shows an erection step of the package according to the second embodiment with a seal applied to the top of the package.

Referring to FIG. 9, a seal 310 further can be applied to one or both ends of the partially erected package 400. The seal 310 can be, for example, a foil membrane, an insert press-fitted into the open package end, etc. Heat or pressure seals can also be used. With such seals, one or both ends of the package 400 can accordingly closed.

Figure 10:
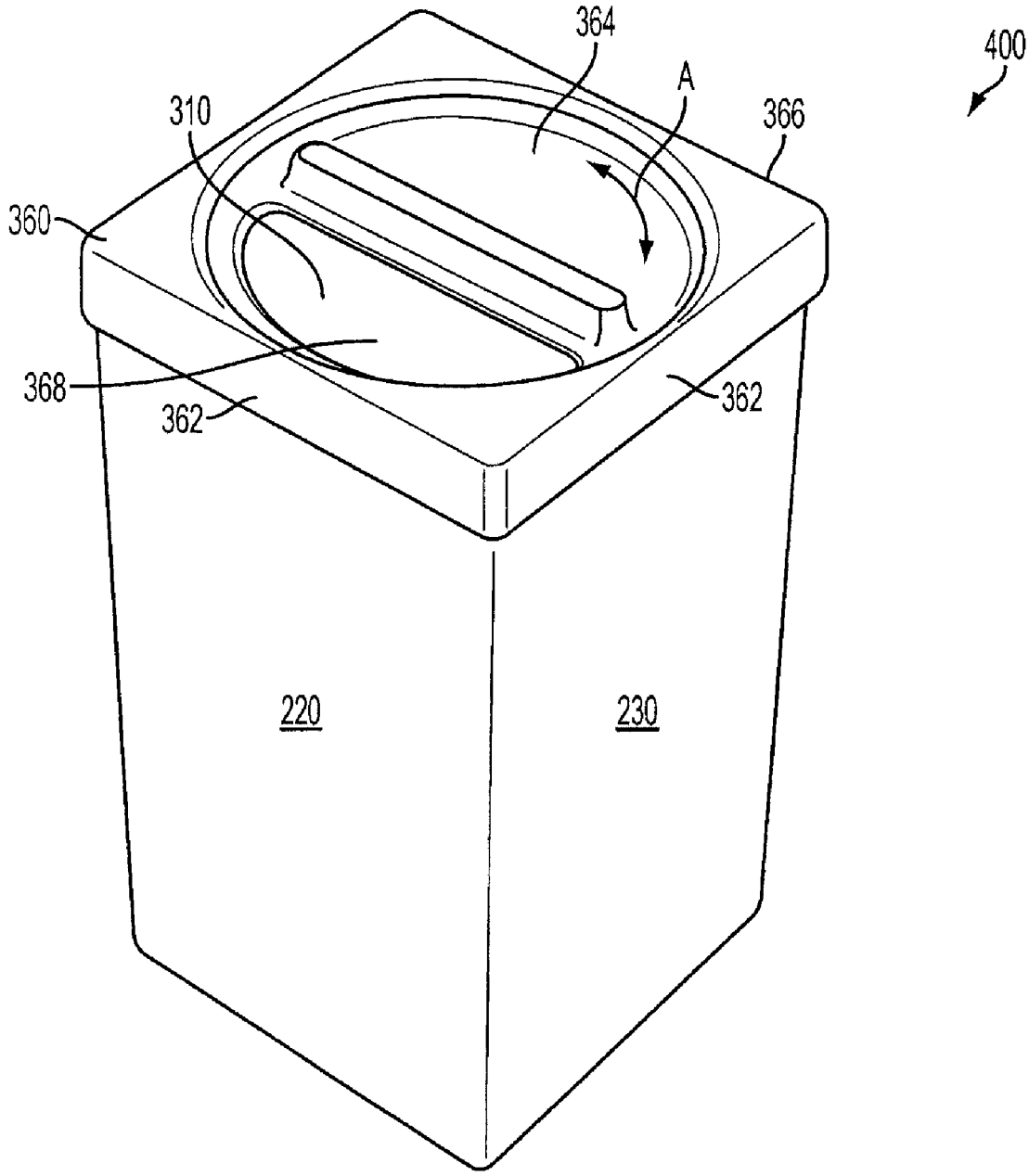
FIG. 10 shows the package according to the second embodiment with a cover applied to the top of the package.

FIG. 10 shows erected package 400, with a dispensing cover 360 mounted to a top of the package. The cover 360 can have a snug, interference fit with the top of the package 400. Indentations 362 also can be included in the cover 360 that press inwardly on the sides of the package. The cover 360 can have a rotatable closure portion 364 mounted in a base 366, which rotates within the base 366, in the direction shown at A, to enable the product to be dispensed from the package 400. The cover 360 further can be made from, for example, plastics, such as polypropylene, polyethylene, polyethylene terephthalate, nylon, paperboard, etc., by injection molding, thermoforming, or die cutting, etc. The rotatable closure portion 364 of the cover 360 can be rotated into an open position to expose a dispenser opening 368 in the base 366.

Figure 11:
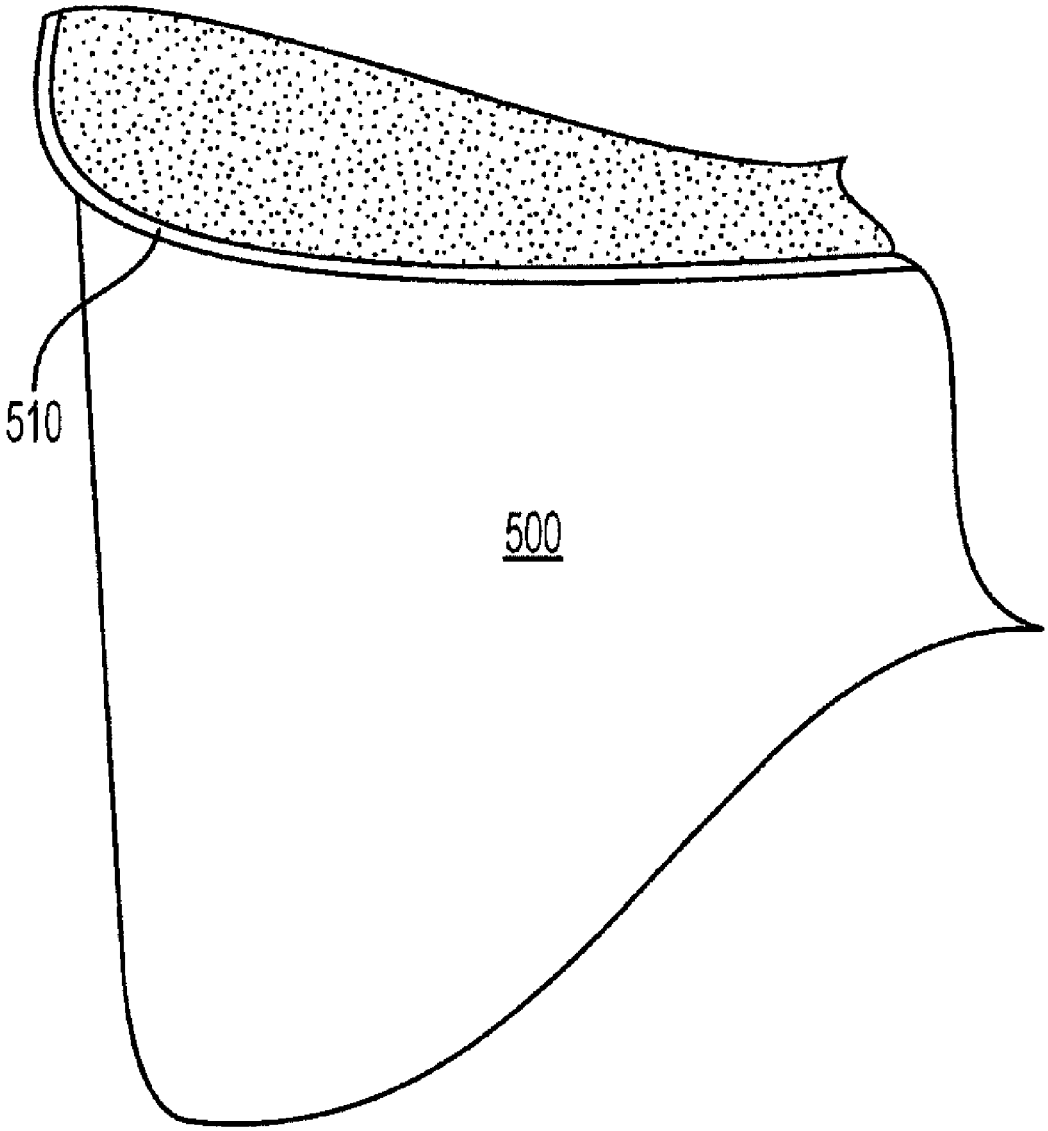
FIG. 11 shows a partial view of a side and rim of a package according to a third embodiment.

FIG. 11 shows a package or carton 500 according to a third embodiment, in which the package has a rolled rim 510 as shown, or any other rim configuration sized to receive a lid. The package shown in FIG. 11 can be formed from a blank similar in design to those shown in FIGS. 1 and 8, can have a liner applied in a similar manner as detailed therein, and/or can have either a seal applied over the opening adjacent the lid or can utilize a folded, rolled, or otherwise deformable liner adjacent or overlapping the rim 510 at the opening adjacent the lid. The lid applied can be of any design shown in subsequent figures herein, with the package varying in size and configuration to receive the lid shown. The package can be formed from, for example paperboard and paper-based materials and formed by tub or cup forming machines.

Figure 12:
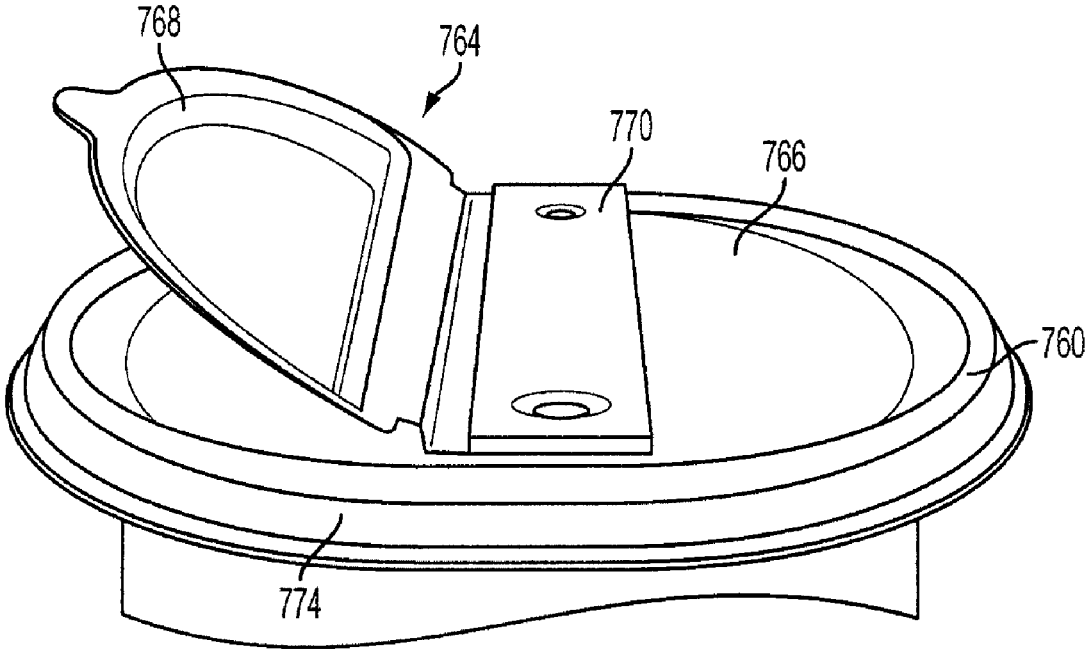
FIG. 12 shows a cover that can be received over a package, such as the package according to the third embodiment.

FIG. 12 shows a cover that can be received over a package, such as the package according to the third embodiment. FIG. 12 shows a cover 760 that fits over a tub-like receptacle, cup, canister, or package, and which can be, for example, formed similar to package 500 (FIG. 11) with rolled rim 510. The cover 760 shown in FIG. 12 is mounted to a top of the receptacle or package and has a closure portion 764 mounted to a base 766. The closure portion 764 includes a hinge or pivot portion 768 that is pivotably or hingedly connected to a stationary portion 770. The stationary portion 770 is attached to the base 766. The cover 760 can include a recessed rim 774 that engages an upper edge of the receptacle and can be formed from, for example, plastics, such as polypropylene, polyethylene, polyethylene terephthalate, nylon, paperboard, etc., by injection molding, thermoforming, or die cutting, etc.

Figure 13:
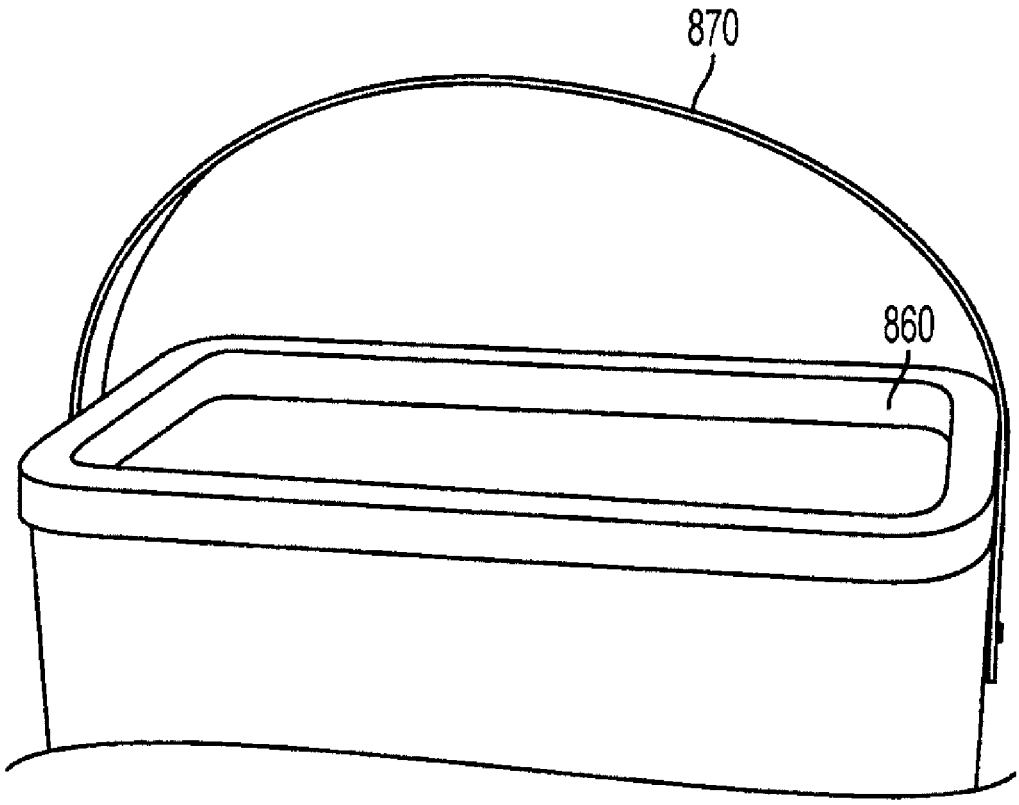
FIG. 13 shows another cover that can be received over a package, such as the package according to the third embodiment.

FIG. 13 also shows a cover that can be received over a package, such as the package according to the third embodiment. FIG. 13 shows a cover 860 that fits over a tub-like receptacle, cup, canister, or package, which can be, for example, formed similar to package 500 with rolled rim 510 of FIG. 11. A handle 870 (FIG. 13) also can be connected at opposite ends of the receptacle. The cover 860 can be formed from, for example plastics, such as polypropylene, polyethylene, polyethylene terephthalate, nylon, paperboard, etc., by injection molding, thermoforming, or die cutting, etc.

Figure 14:
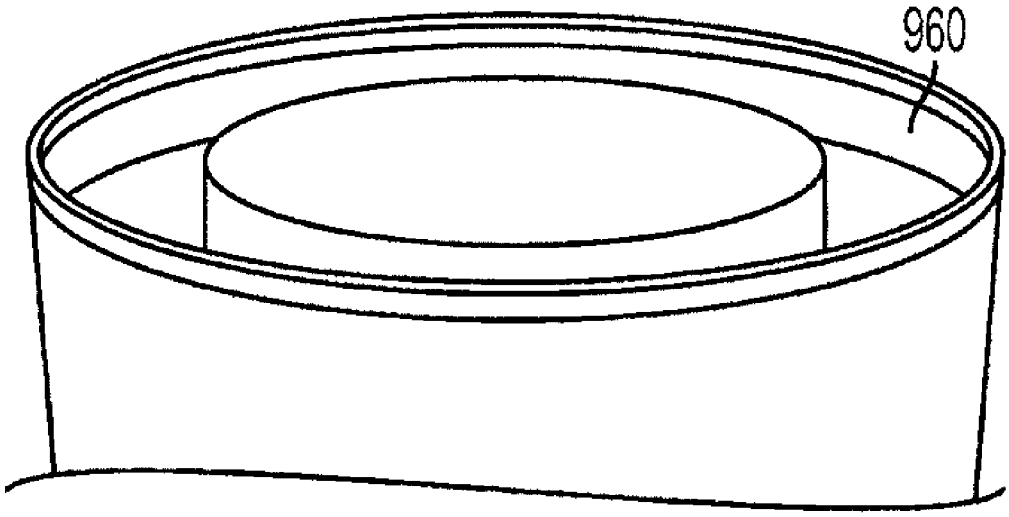
FIG. 14 shows a cover that can be received over a package, such as the package according to the third embodiment.

FIG. 14 shows a cover that can be received over a package, such as the package according to the third embodiment. FIG. 14 shows a cover 960 having the form of a generally disc-like insert pressed into the open top end of the package. The cover 960 can be formed from, for example plastics, such as polypropylene, polyethylene, polyethylene terephthalate, nylon, paperboard, etc., by injection molding, thermoforming, or die cutting, etc.

Figure 15:
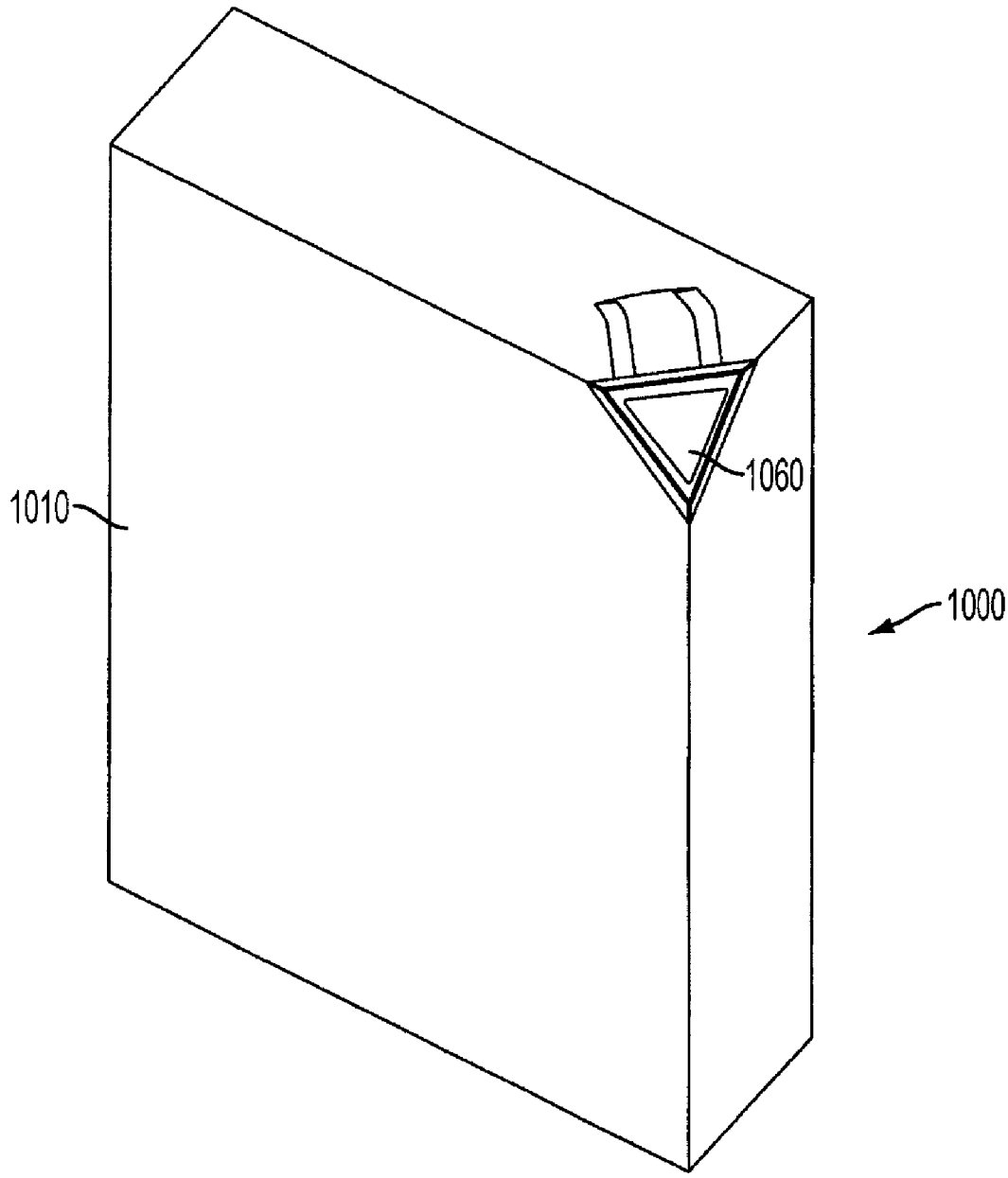
FIG. 15 shows a package according to a fourth embodiment.
Figure 16A:
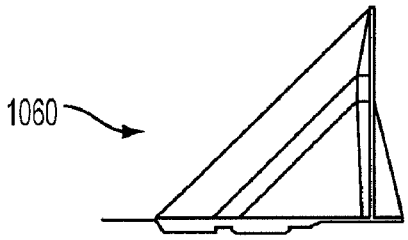
FIGS. 16A-E show a dispenser usable on the fourth package embodiment.
Figure 16B:
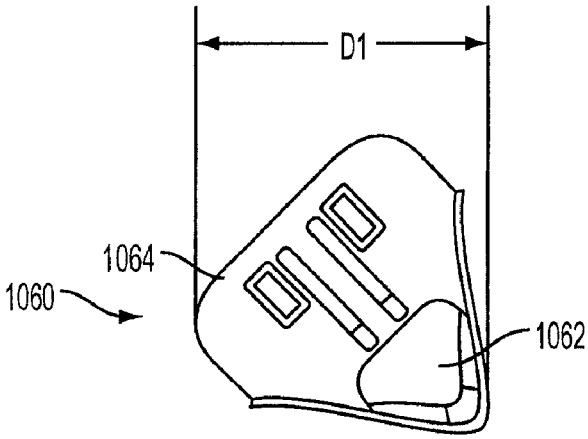
Figure 16D:
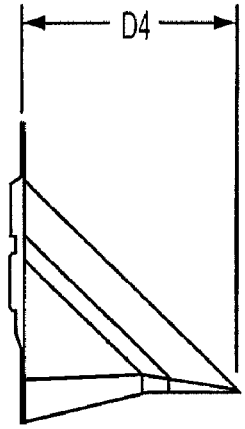
Figure 16C:
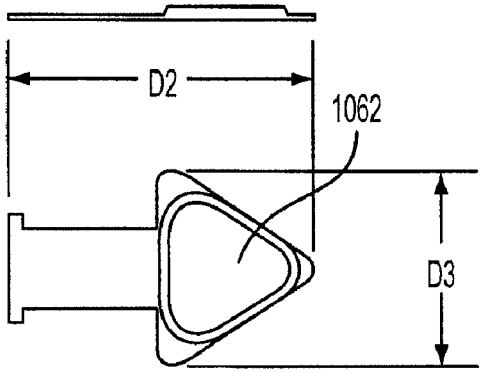
Figure 16E:
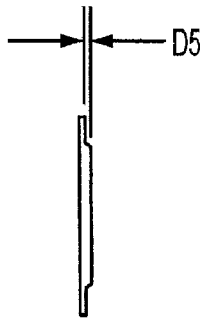

FIG. 15 shows a package 1000 according to a fourth embodiment of the invention. The package 1000 includes a dispenser 1060 mounted at a corner of a parallelepipedal receptacle 1010 of the package 1000. The dispenser 1060 may be, for example, fixedly or removably mounted in the receptacle 1010. The receptacle 1010 can be formed from, for example paperboard and paper-based materials.

FIGS. 16A-E show the dispenser 1060 usable on the fourth package embodiment. The dispenser 1060 includes a pivoting or hinged portion 1062 mounted to a base portion 1064. The pivoting portion 1062 can be pivoted open to expose an opening in the base 1064. The corner of the receptacle 1010 can include an opening 1012 corresponding to the opening in the dispenser 1060. The opening in the receptacle 1010 also can be covered by a breachable or removable seal, such as a foil. The dispenser 1060 can be formed from, for example plastics, such as polypropylene, polyethylene, polyethylene terephthalate, nylon, paperboard, etc., by injection molding, thermoforming, or die cutting, etc. The dispenser 1060 can be incorporated into any of the packages or cartons disclosed in this specification. The dispenser 1060 can have exemplary dimensions as necessary, with D1 being up to about ±3 inches, such as ±2.669 inches, D2 being up to about ±3 inches, such as ±2.698 inches, D3 being up to about ±2 inches, such as ±1.745 inches, D4 being up to about ±2 inches, such as ±1.888 inches, and D5 being up to about ±1-inch, such as ±0.080 inches, with the spacing/distances being variable, depending on the size of the dispenser 1060.

Figure 17:
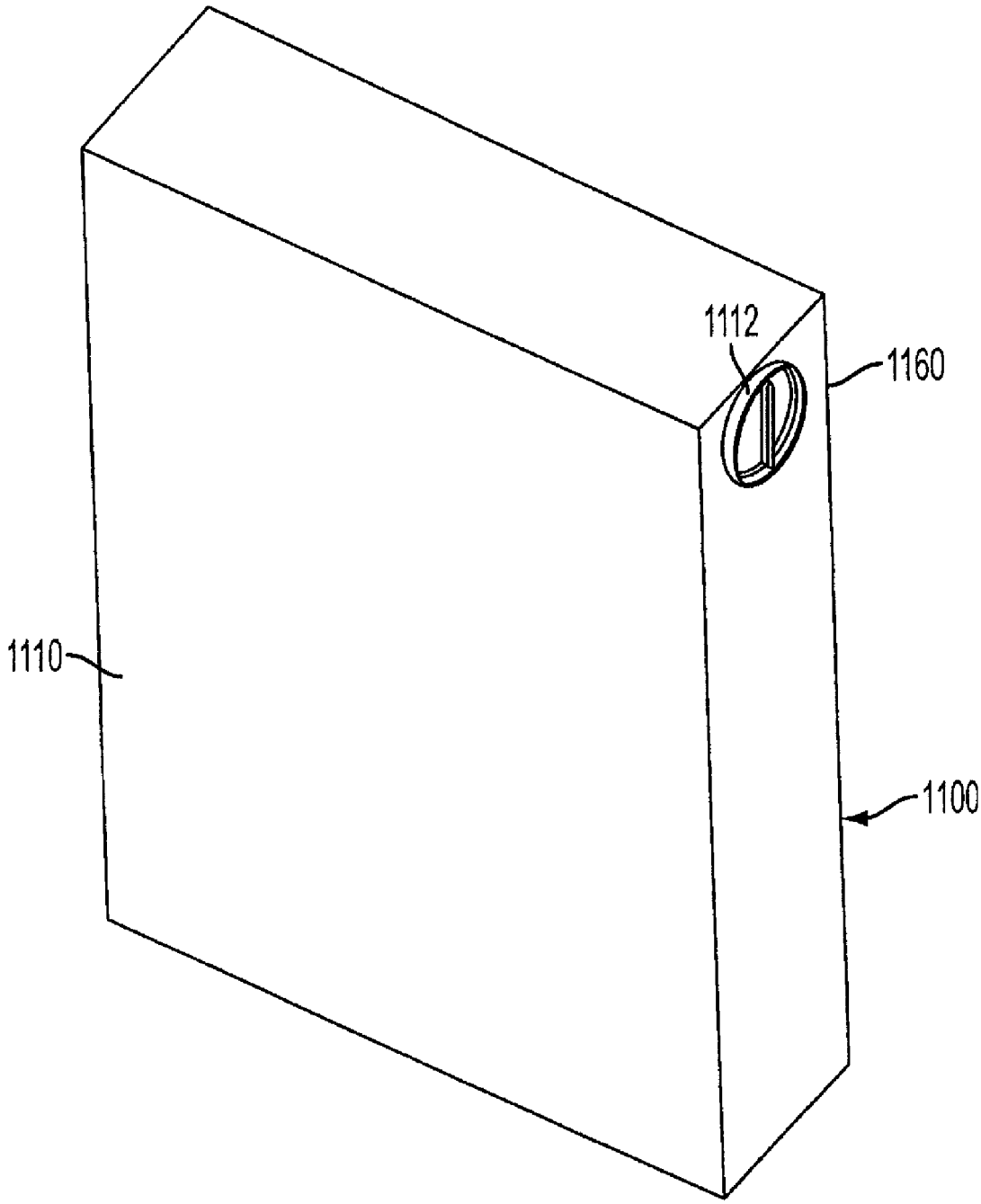
FIG. 17 shows a package according to a fifth embodiment.
Figure 18A:
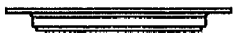
FIGS. 18A-F show the dispenser usable on the fifth package embodiment.
Figure 18B:
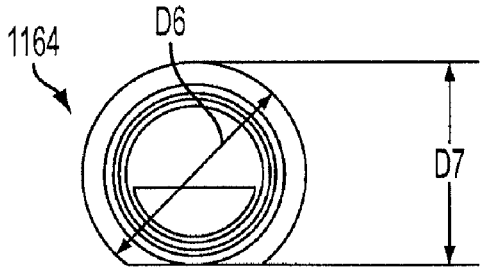
Figure 18C:
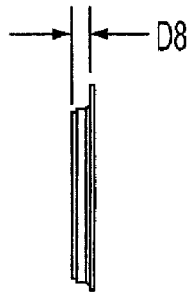
Figure 18D:
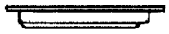
Figure 18E:
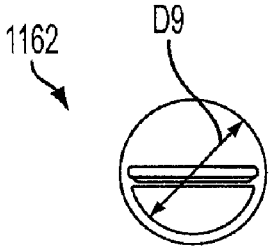
Figure 18F:
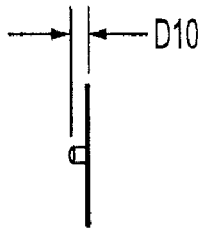

FIG. 17 show a package 1100 according to a fifth embodiment. The package 1100 includes an opening 1112 having a dispenser 1160 mounted thereto. The opening 1112 generally can be formed at an end of a parallelepipedal receptacle 1110 of the package 1100. The dispenser 1160 may be, for example, fixedly or removably mounted in the receptacle 1110.

FIGS. 18A-F show the dispenser 1160 usable on the fifth package embodiment. The dispenser 1160 includes a rotatable portion 1162 mounted to a base portion 1164. The rotatable portion 1162 can be rotated in the direction of the bidirectional arrow to open to expose an opening in the base 1164. The end of the receptacle 1110 can include an opening 1112 corresponding to the opening in the dispenser 1160. The opening 1112 (FIG. 17) in the receptacle 1110 can also be covered by a breachable or removable seal, such as a foil. The dispenser 1160 can be incorporated into any of the packages or cartons disclosed in this specification. The dispenser 1160 can have exemplary dimensions as necessary, with D6 being up to about ±2 inches, D7 being up to about ±2 inches, such as ±1.824 inches, D8 being up to about ±1-inch, such as ±0.150 inches, D9 being up to about ±2 inches, such as ±1.290 inches, and D10 being up to about ±1 inch, such as ±0.150 inches, with the spacing/distances being variable, depending on the size of the dispenser 1160.

Figure 19:
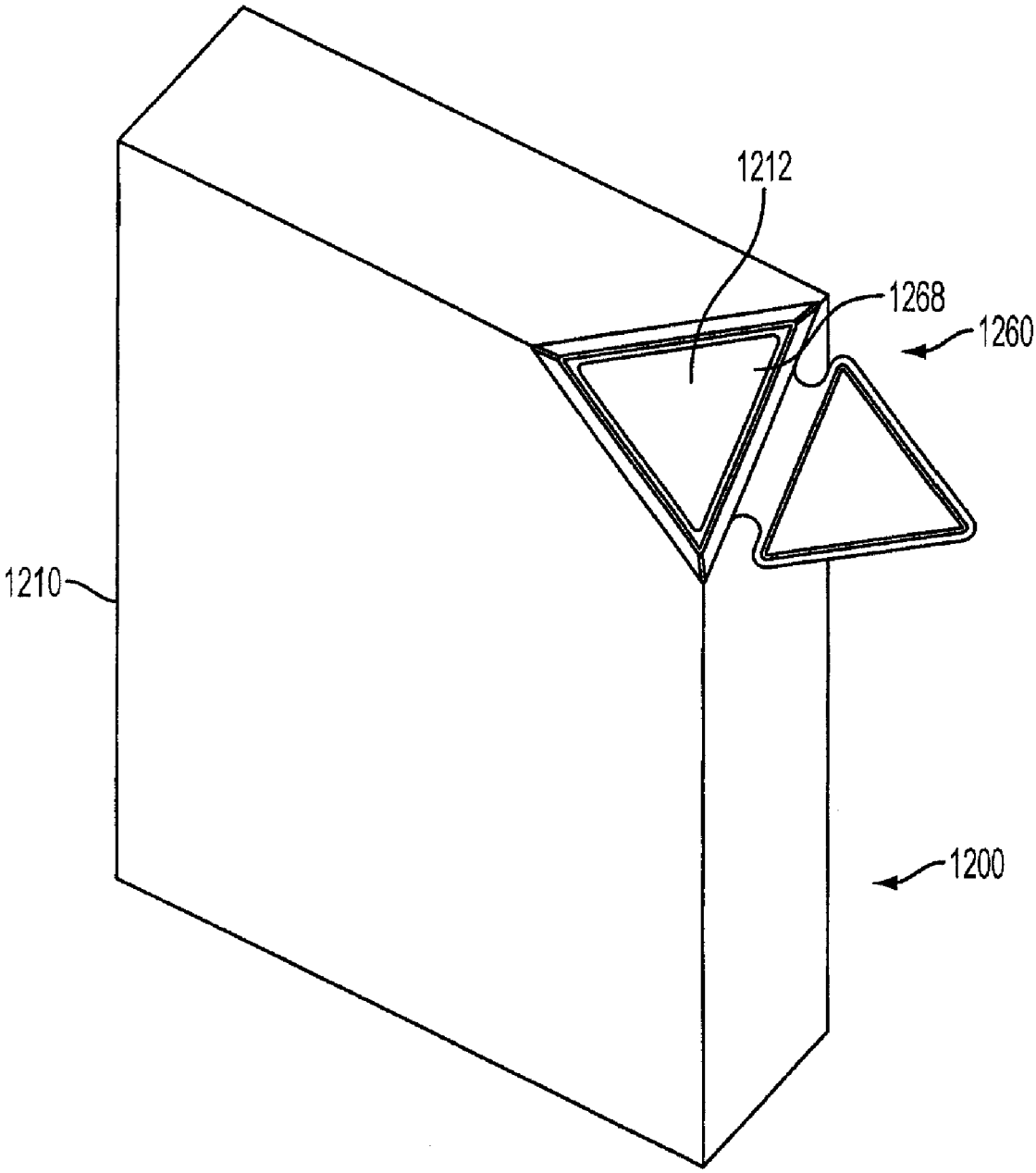
FIG. 19 shows a package according to a sixth embodiment.

FIG. 19 show a package 1200 according to a sixth embodiment. The package 1200 includes a dispenser 1260 mounted about an opening 1212 formed at a corner of a parallelepipedal receptacle 1210 of the package 1200. The dispenser 1260 may be, for example, fixedly or removably mounted in the receptacle 1210.

Figure 20A:
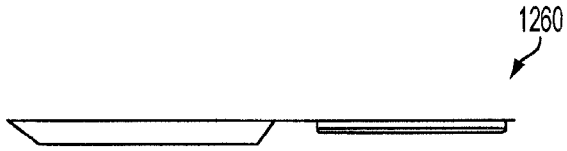
FIGS. 20A-C show a dispenser usable on the sixth package embodiment.
Figure 20B:
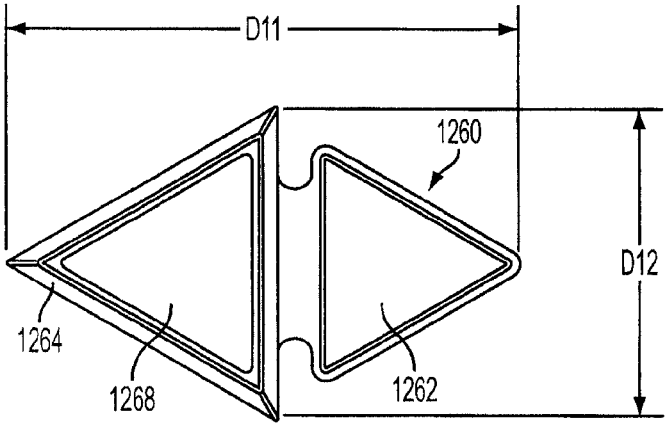
Figure 20C:
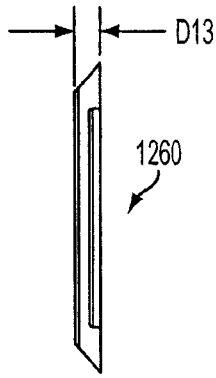

FIG. 20A-C show the dispenser 1260 usable on the sixth package embodiment. The dispenser 1260 includes a pivoting or hinged portion 1262 mounted to a base portion 1264. The pivoting portion 1262 can be pivoted open to expose an opening 1268 in the base 1264 with the opening 1212 in corner of the receptacle 1210 corresponding to the opening 1268 in the dispenser 1260. The opening 1212 in the receptacle 1210 can also be covered by a breachable or removable seal, such as a foil. The dispenser 1260 can be incorporated into any of the packages or cartons disclosed in this specification. The dispenser 1260 can have exemplary dimensions as necessary, with D11 being up to about ±6 inches, such as ±5.459 inches, D12 being up to about ±4 inches, such as ±3.291 inches, and D13 being up to about ±1 inch, such as ±0.270 inches, with the spacing/distances being variable, depending on the size of the dispenser 1260.

Figure 21A:
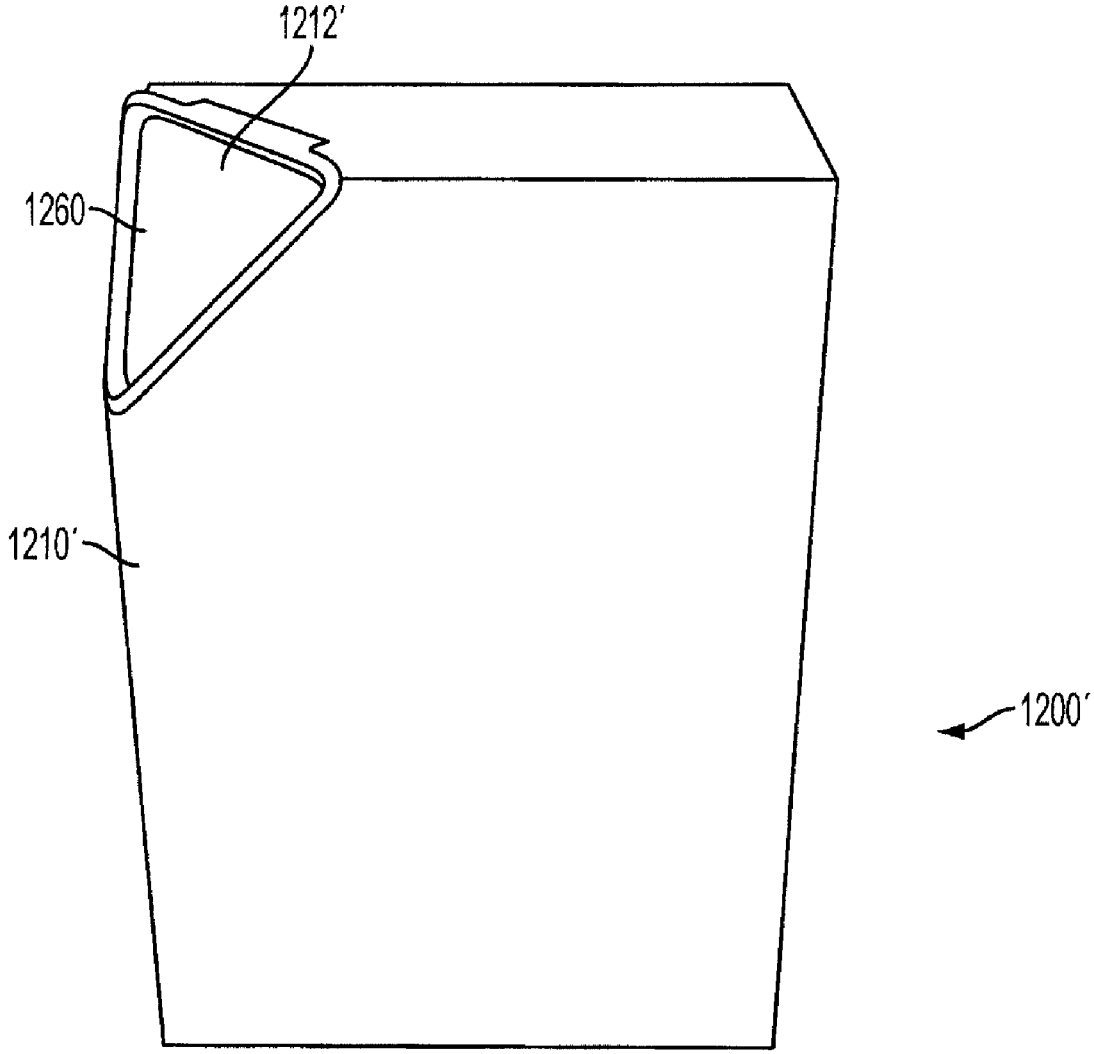
FIG. 21A shows a package according to a seventh embodiment.
Figure 21B:
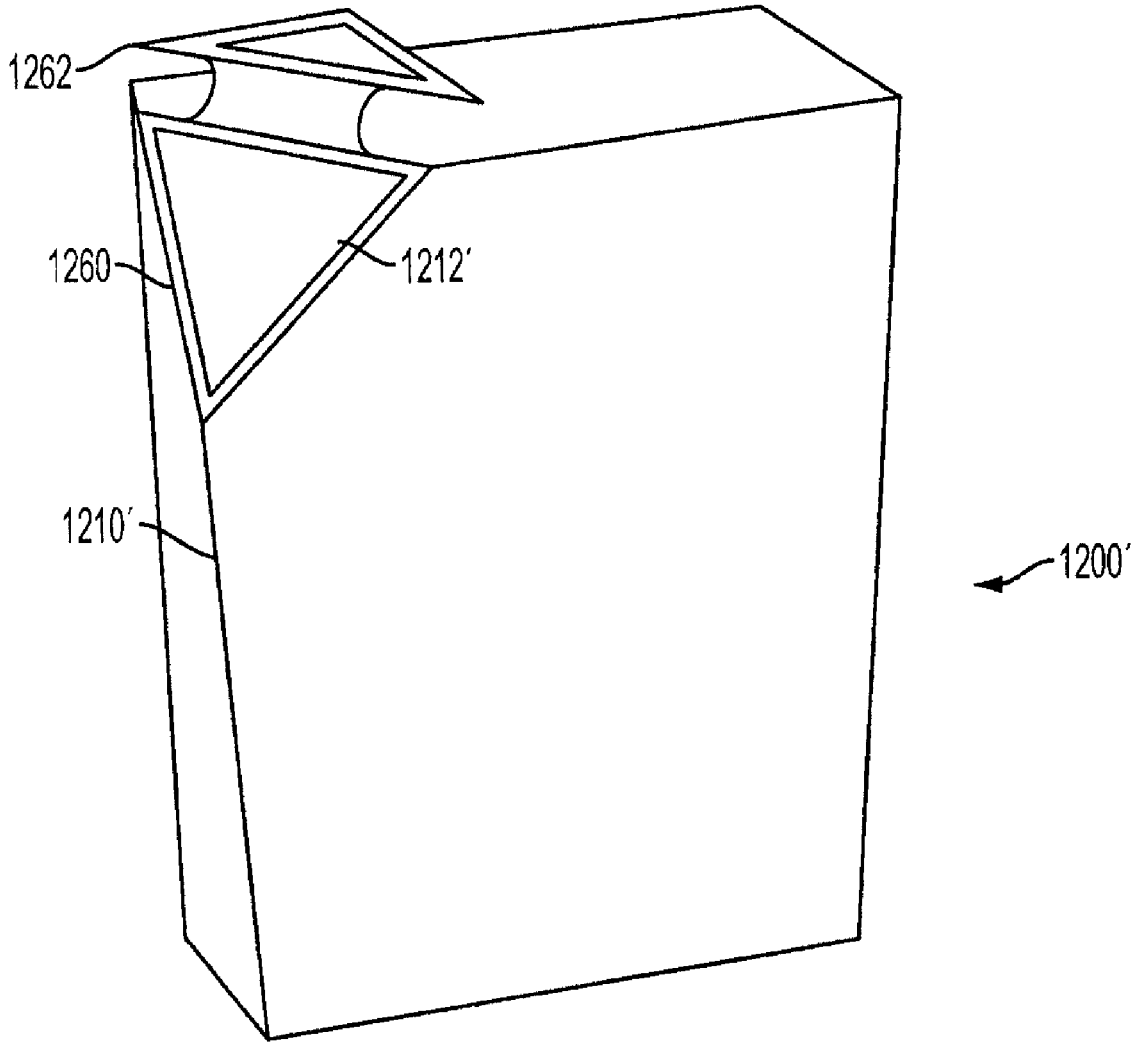
FIG. 21B shows a dispenser usable on the seventh package embodiment.

FIG. 21A shows a package 1200' according to a seventh embodiment, the seventh embodiment being similar to the sixth embodiment with the opening being disposed in an alternate corner. FIG. 21B shows a dispenser usable on the seventh embodiment. Package 1200' is substantially identical to package 1200 illustrated in FIG. 20A. The package 1200', however, has dispenser 1260 mounted over an opening 1212' at a different corner of the receptacle 1210'. Also, dispenser 1260 is mounted in a different orientation on the package 1200' so that the pivoting portion 1262 pivots upwardly. Dispenser 1260 is capable of being mounted in three orientations on a package. FIG. 21B shows dispenser pivoting portion 1262 pivoted open.

Figure 22A:
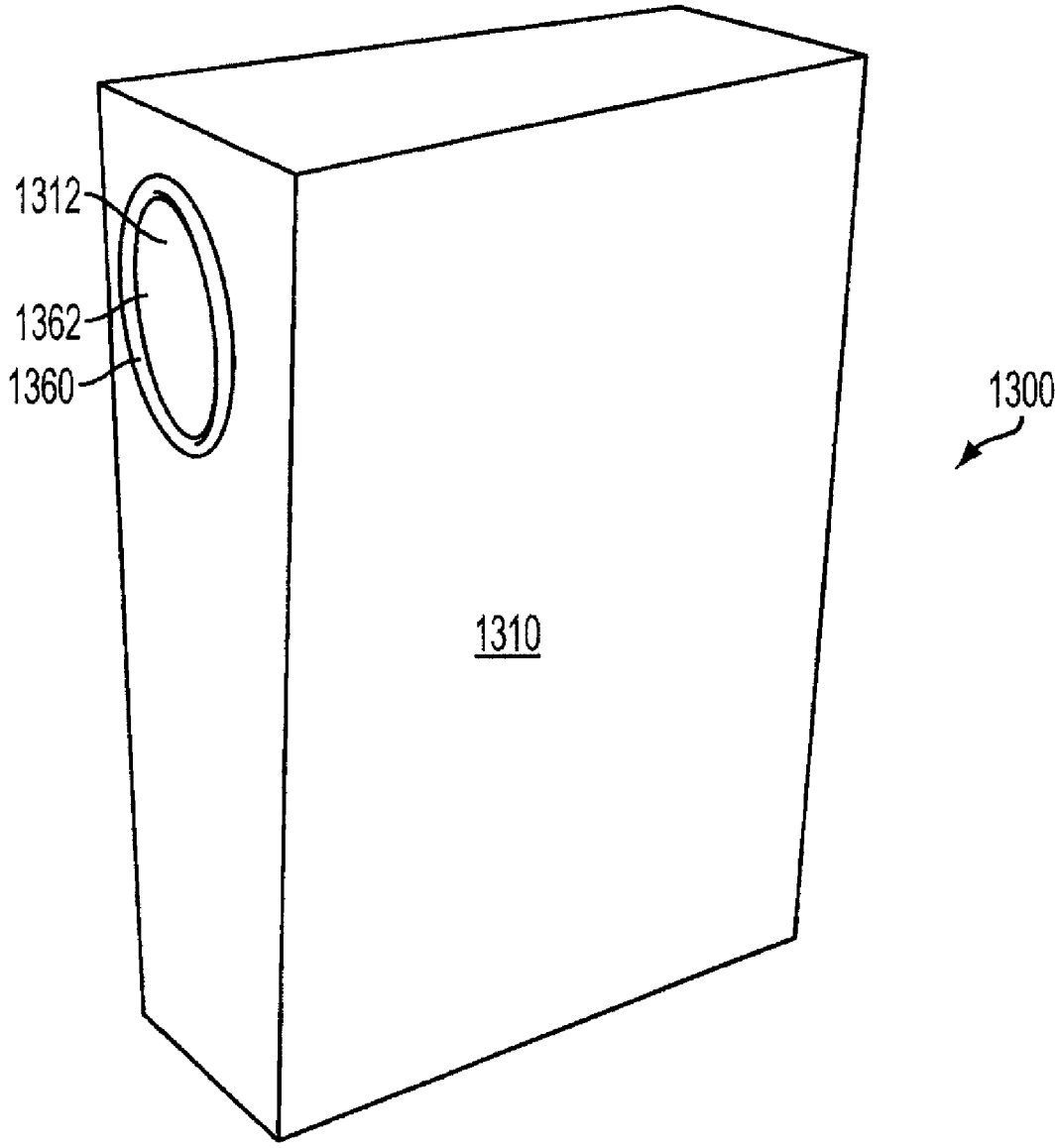
FIG. 22A shows a package according to an eighth embodiment.
Figure 22B:
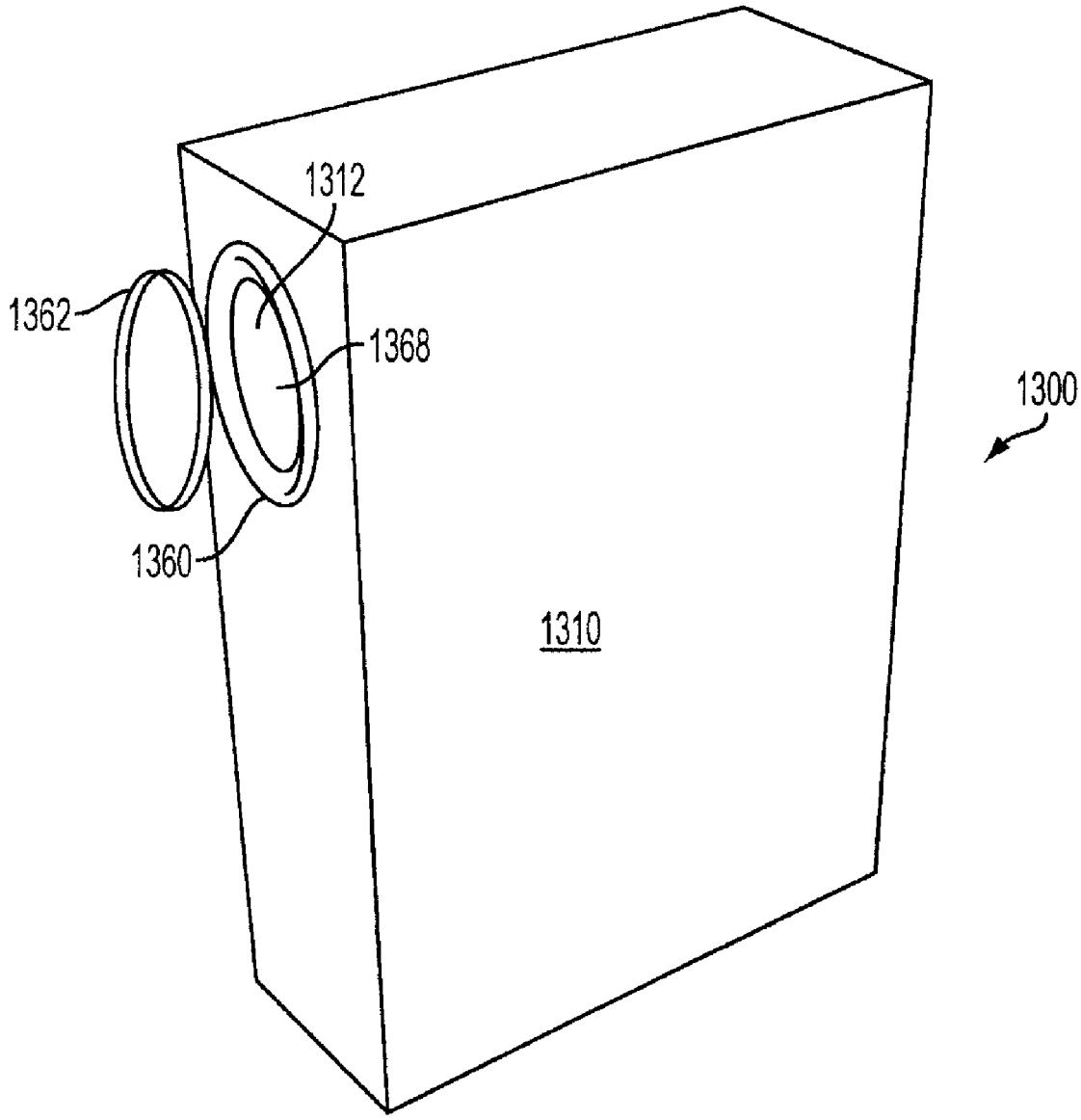
FIGS. 22B-F show a dispenser usable on the eighth package embodiment.
Figure 22C:
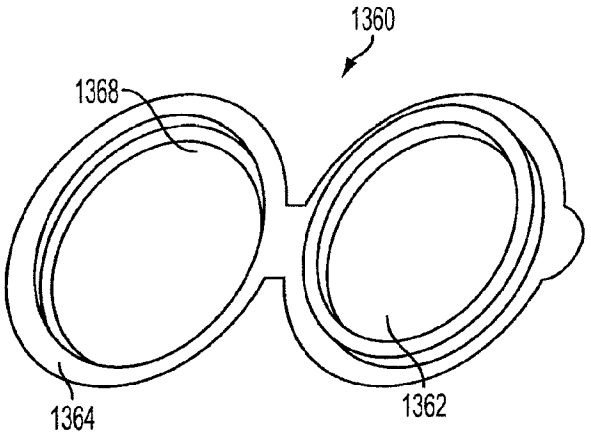
Figure 22F:
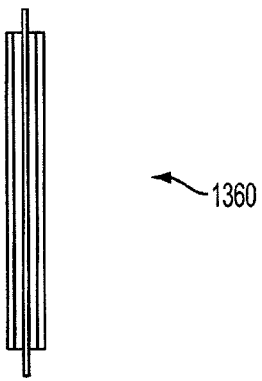
Figure 22D:
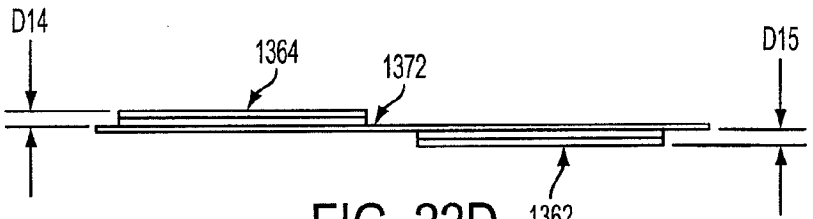
Figure 22E:
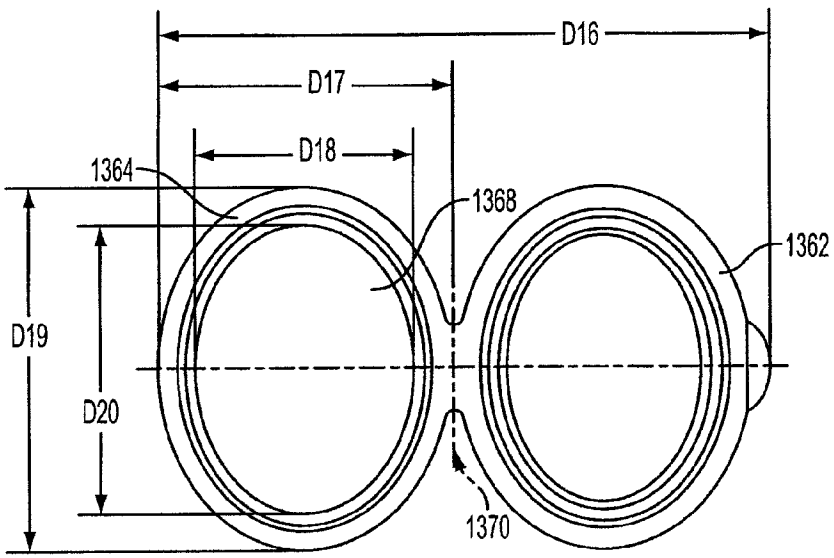

FIG. 22A illustrates a package 1300 according to an eighth embodiment. The package 1300 includes a dispenser 1360 mounted at an end of a parallelepipedal receptacle 1310 of the package 1300. The dispenser 1360 may be, for example, fixedly or removably mounted in the receptacle 1310. The dispenser 1360 can be mounted over an opening 1312 of the receptacle 1310 in any rotational orientation so that a pivoting or hinged portion 1360 of the dispenser can open in any direction. The opening 1312 in the receptacle 1310 can also be covered by a breachable or removable seal, such as a foil. FIG. 22B illustrates the hinged portion 1362 of the dispenser 1360 pivoted open.

FIGS. 22C-F show several views of dispenser 1360. The dispenser 1360 includes a pivoting portion 1362 mounted to a base portion 1364. The pivoting portion 1362 can be pivoted open to expose an opening 1368 in the base 1364 of the dispenser 1360. The dispenser 1360 can be formed from, for example, plastics such as polypropylene, polyethylene, polyethylene terephthalate, nylon, paperboard, etc., by injection molding, thermoforming, or die cutting, etc. The dispenser 1360 can be incorporated into any of the packages or cartons disclosed in this specification. The dispenser 1360 can have exemplary dimensions as necessary, with D14 being up to about ±1 inch, such as ±0.100 inches, D15 being up to about ±1 inch, such as ±0.090 inches, D16 being up to about ±4 inches, such as ±3.343 inches, D17 being up to about ±2 inches, such as ±1.615 inches, D18 being up to about ±2 inches, such as ±1.185 inches, D19 being up to about ±2 inches, and D20 being up to about ±2 inches, such as ±1.585 inches, with the spacing/distances being variable, depending on the size of the dispenser 1360.

Figure 23A:
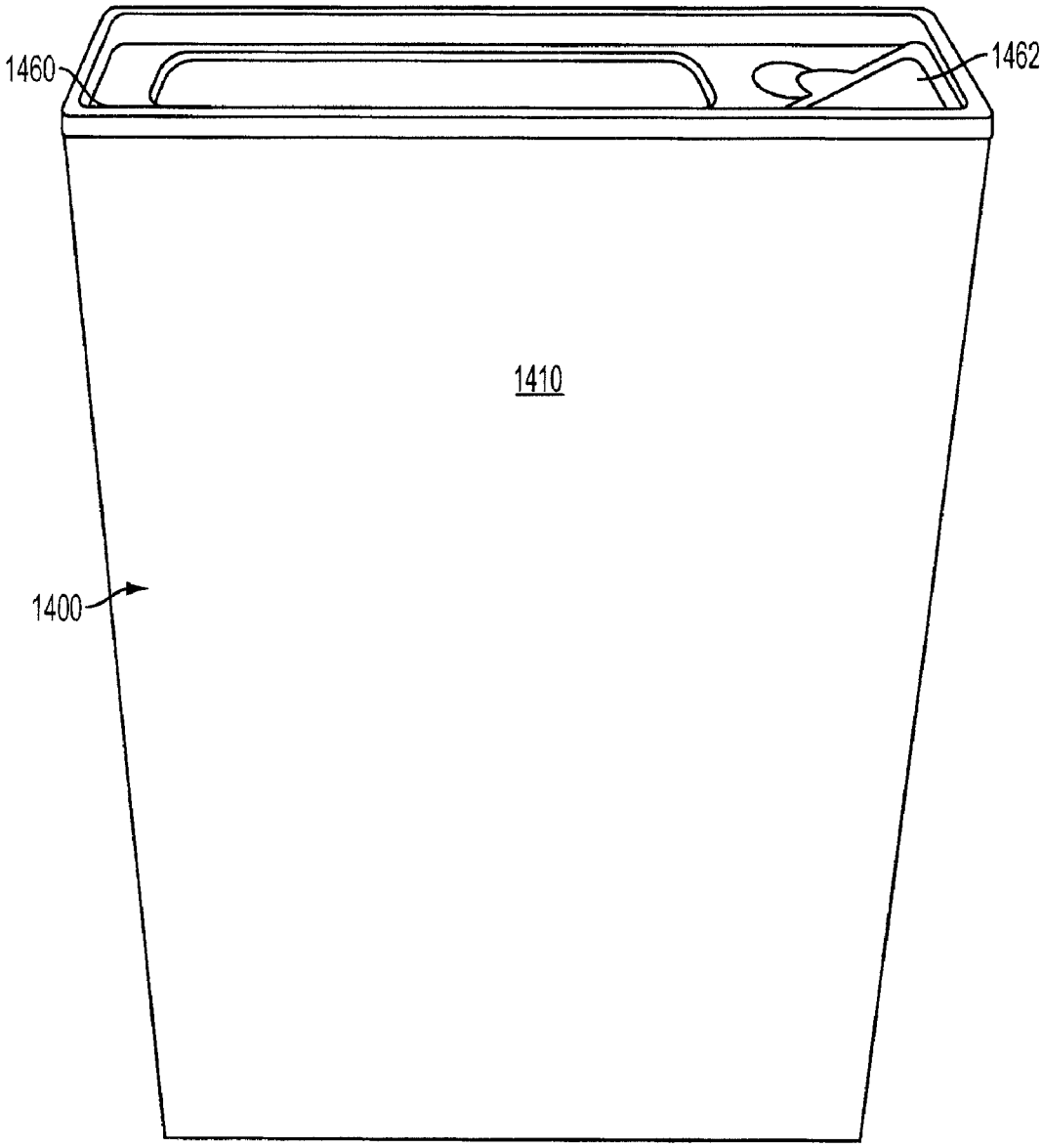
FIG. 23A shows a package according to a ninth embodiment.
Figure 23B:
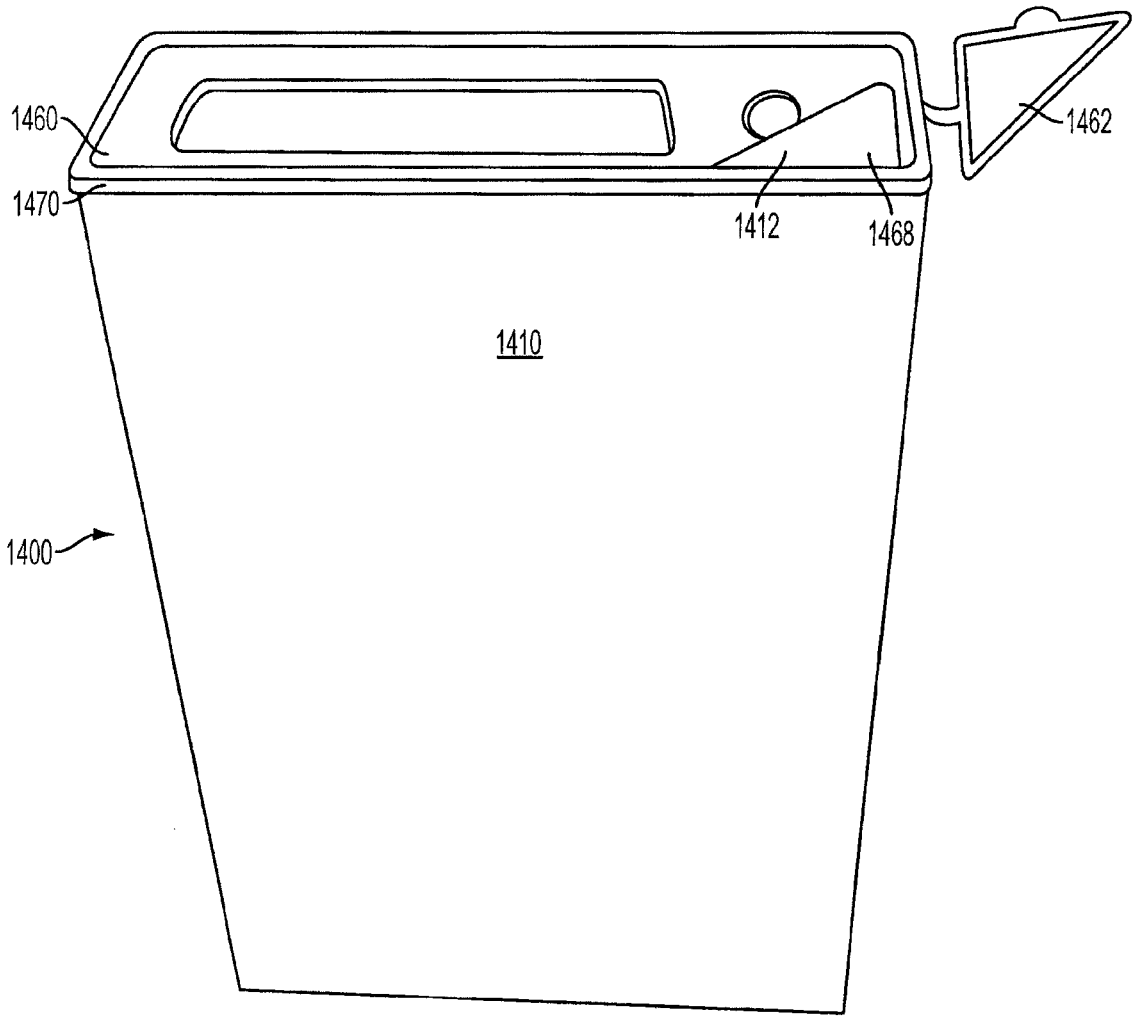
FIGS. 23B-F shows a dispenser usable on the ninth package embodiment.
Figure 23D:
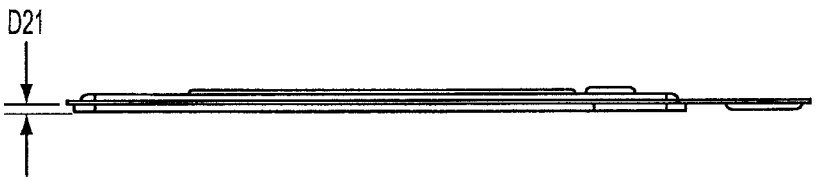
Figure 23F:
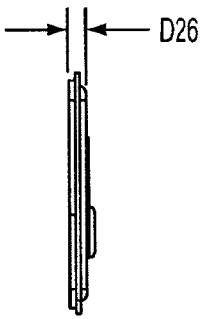
Figure 23C:
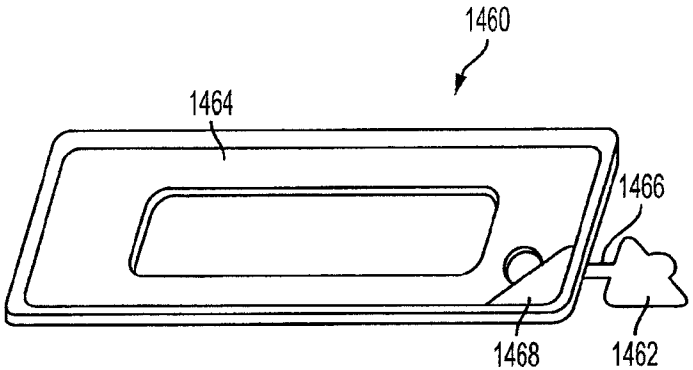
Figure 23E:
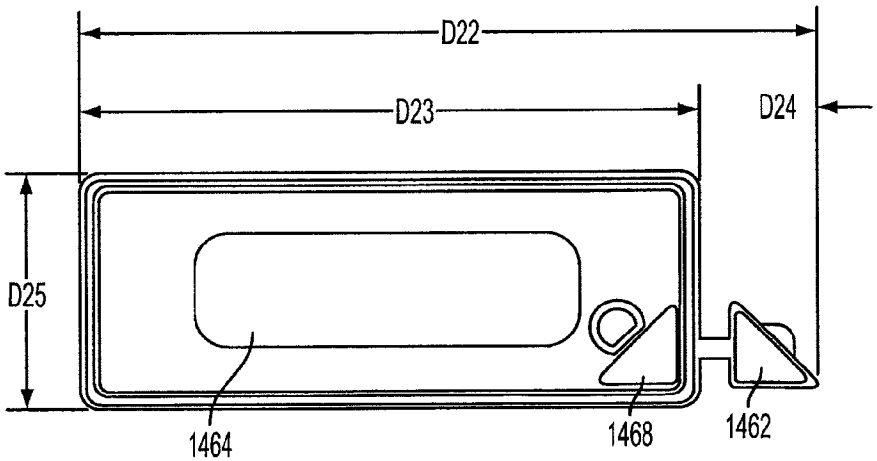

FIG. 23A shows a package 1400 according to a ninth embodiment. The package 1400 includes a dispenser 1460 mounted at a top of a substantially parallelepipedally shaped receptacle 1410. The dispenser 1460 may be, for example, fixedly or removably mounted on the receptacle 1410. FIG. 23B illustrates the hinged portion 1462 pivoted open to exposing an opening 1412 at a top of receptacle 1410.

FIGS. 23C-F show several views of dispenser 1460. The dispenser 1460 includes a pivoting portion 1462 mounted to a base portion 1464 by a flexible hinge 1466. The pivoting portion 1462 can be pivoted open to expose an opening 1468 in the base 1464. Referring also to FIG. 23A, the dispenser 1460 includes a recessed rim 1470 that mounts to an upper edge of receptacle 1410. The dispenser 1460 can be incorporated, for example, into any of the packages or cartons disclosed in this specification. The dispenser 1460 can have exemplary dimensions as necessary, with D21 being up to about ±1 inch, such as ±0.105 inches, D22 being up to about ±10 inches, such as ±9.640 inches, D23 being up to about ±9 inches, such as ±8.120 inches, D24 being up to about ±2 inches, such as ±1.520 inches, D25 being up to about ±4 inches, such as ±3.120 inches, and D26 being up to about ±1 inch, such as ±0.220 inches, with the spacing/distances being variable, depending on the size of the dispenser 1460.

Figure 24A:
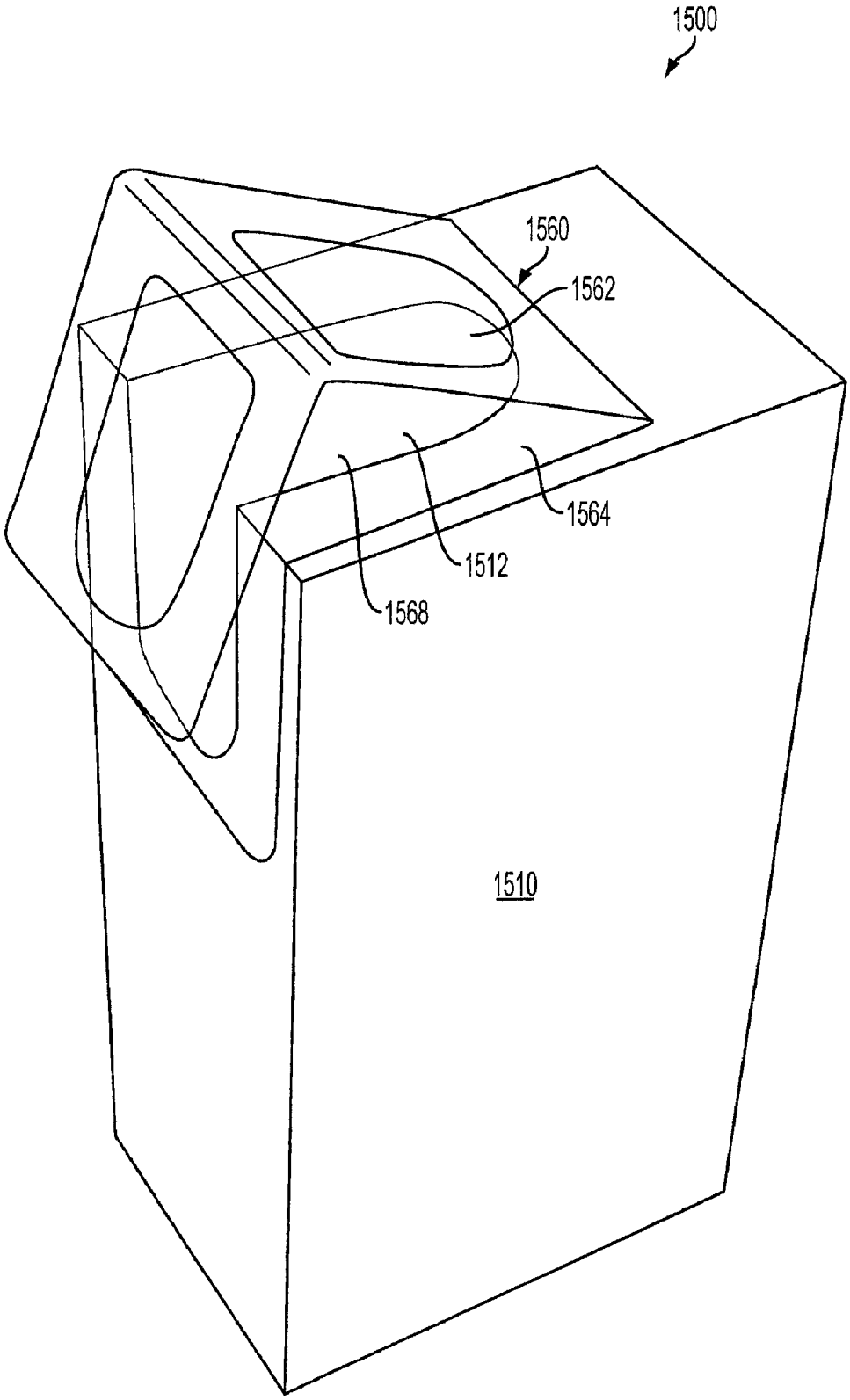
FIG. 24A shows a package according to a tenth embodiment.
Figure 24B:
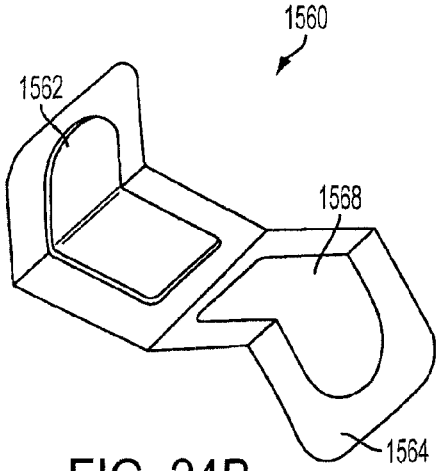
FIGS. 24B-E shows a dispenser usable on the tenth package embodiment.
Figure 24C:
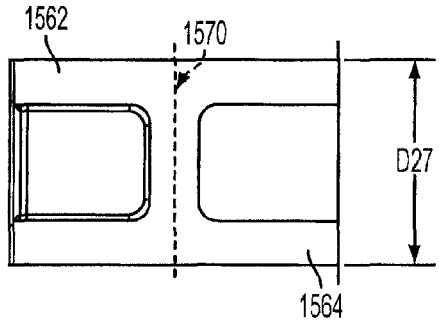
Figure 24D:
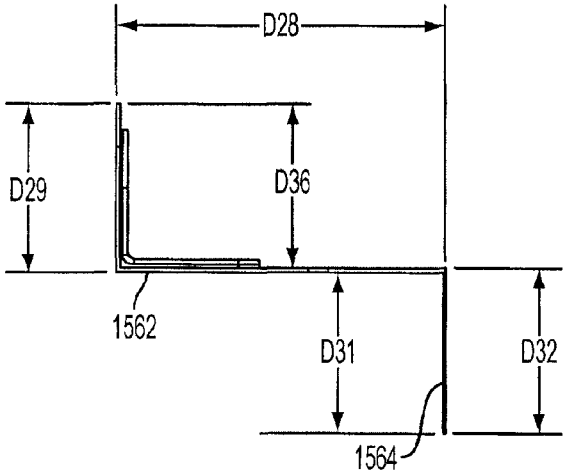
Figure 24E:
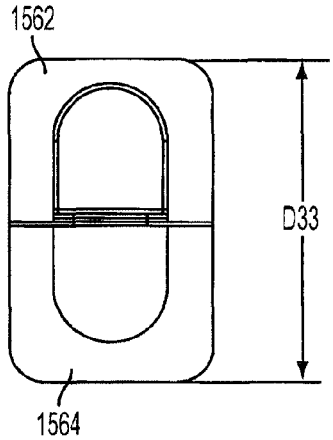

FIG. 24A shows a package 1500 according to a tenth embodiment. The package 1500 includes a dispenser 1560 mounted at a top of a parallelepipedal receptacle 1510 over or on an opening 1512 formed in the receptacle 1510. FIGS. 24B-E show several views of dispenser 1560. The dispenser 1560 includes a hinged or pivoting portion 1562 mounted to a base portion 1564. The pivoting portion 1562 can be pivoted open to expose an opening 1568 in the base 1564 of the dispenser, correspondingly exposing opening 1512 at a top of receptacle 1510. The dispenser 1560 can be incorporated into any of the packages or cartons disclosed in this specification. The dispenser 1560 can have exemplary dimensions as necessary, with D27 being up to about ±2 inches, such as ±1.250 inches, D28 being up to about ±3 inches, such as ±2.020 inches, D29 being up to about ±2 inches, such as ±1.020 inches, D30 being up to about ±1 inch, D31 being up to about ±1 inch, such as ±0.980 inches, D32 being up to about ±1 inch, and D33 being up to about ±2 inches, with the spacing/distances being variable, depending on the size of the dispenser 1560.

Figure 25:
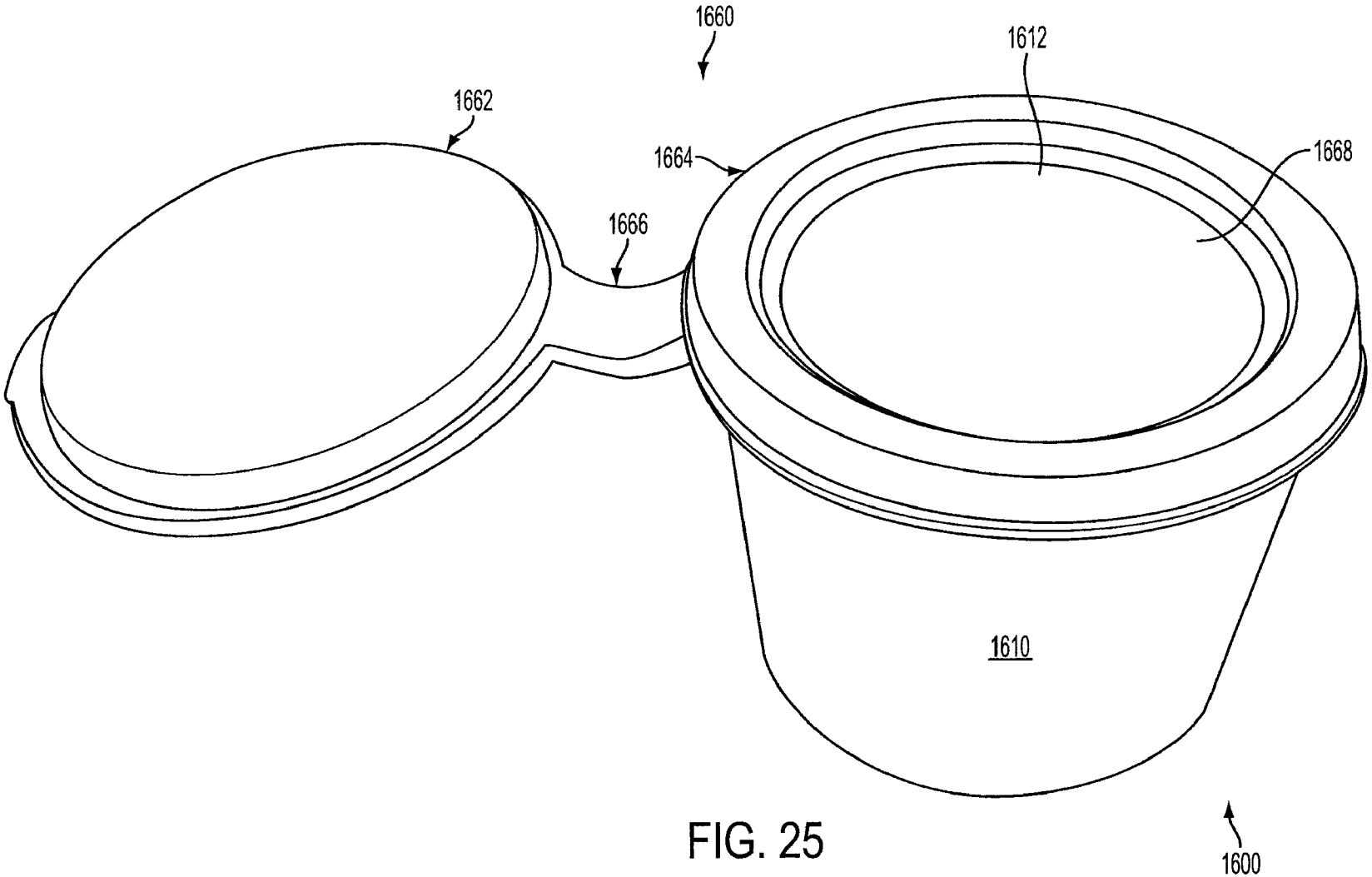
FIG. 25 shows a cover received over a package according to an eleventh embodiment.

FIG. 25 shows a package 1600 according to an eleventh embodiment. The package 1600 includes a dispenser 1660 mounted at a top of a cup-like or cylindrical receptacle 1610 over or on an opening 1612 formed in the receptacle 1610. As shown in FIG. 25, dispenser 1660 includes a hinged or pivoting portion 1662 mounted to a base portion 1664, with a hinge 1666 therebetween. The pivoting portion 1662 can be pivoted open to expose an opening 1668 in the base 1664, exposing opening 1612 at a top of receptacle 1610. The dispenser 1660 can be incorporated into any of the packages or cartons disclosed in this specification.

Figure 26A:
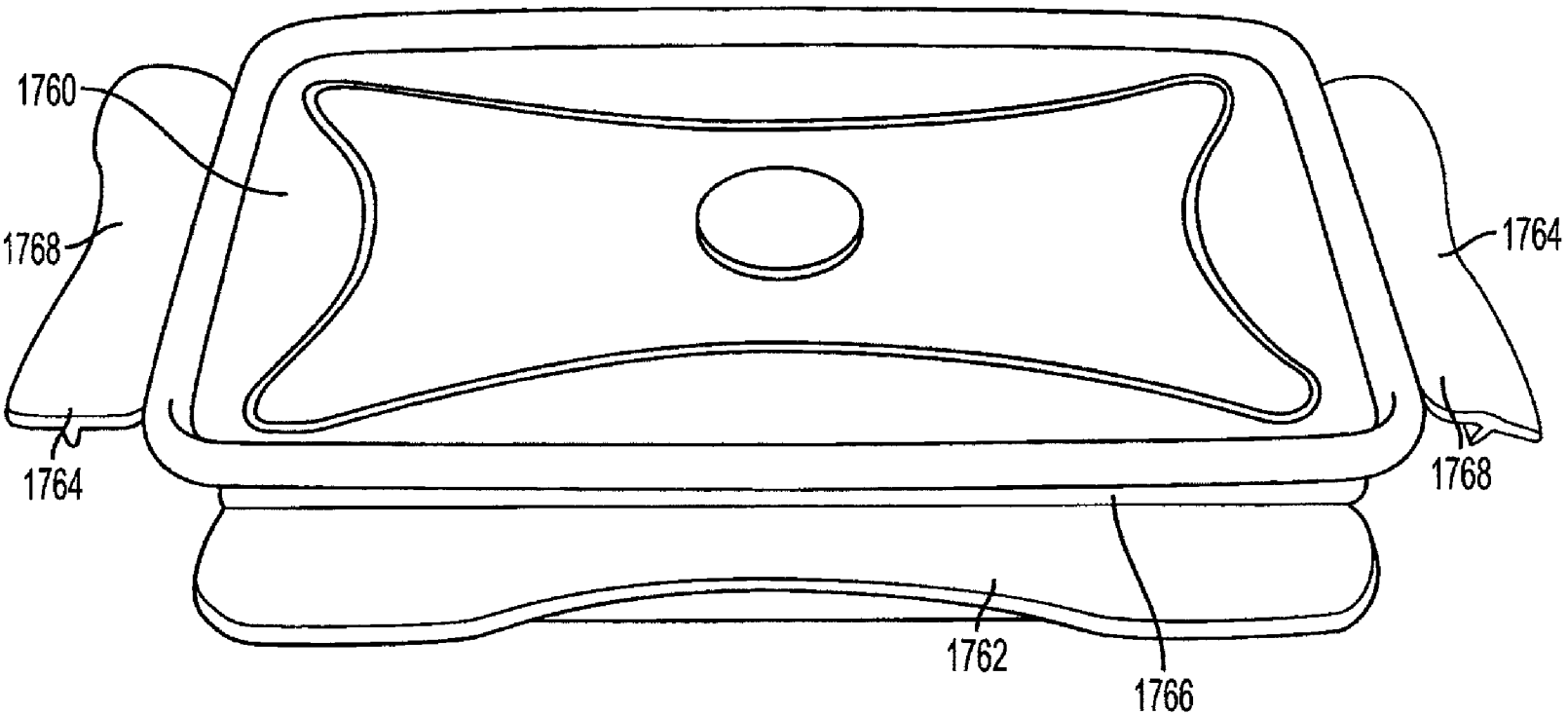
FIGS. 26A and 26B show a cover that can be received over a package, such as, for example, the package according to the third or eleventh embodiments.
Figure 26B:
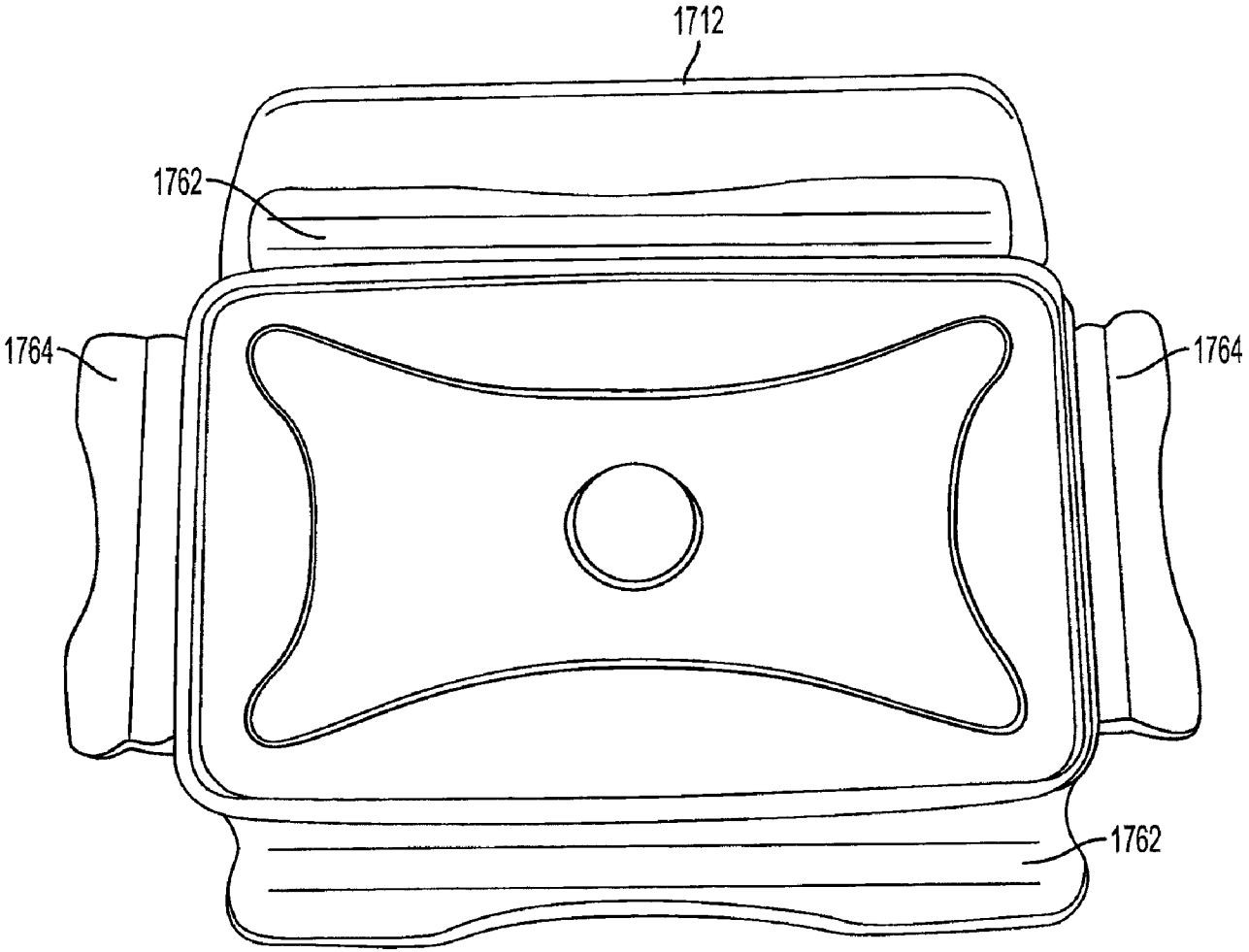

FIGS. 26A and 26B show a cover 1760 that can be received over a package, such as the package according to the third or eleventh embodiments. The cover 1760 includes hinged closure flaps 1762 and hinged closure flaps 1764, with each pair disposed at opposite ends of the cover. The closure flaps 1762, 1764 pivot downwardly about flexible pivot or hinge portions 1766, 1768, respectively of the cover 1760 to engage a peripheral rim of the receptacle. The closure flaps 1762, 1764 thereby secure the cover 1760 to the receptacle.

Figure 27A:
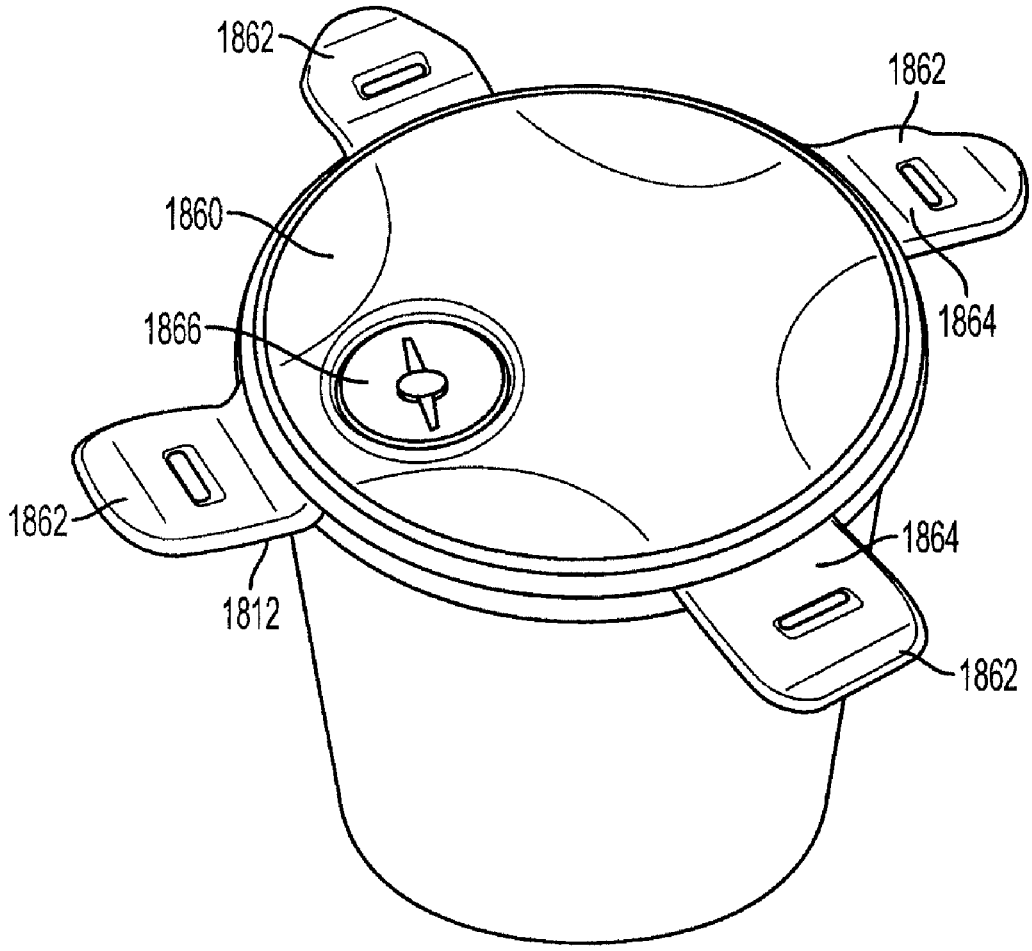
FIGS. 27A-C show a cover that can be received over a package, such as, for example, the package according to the third or eleventh embodiments.
Figure 27B:
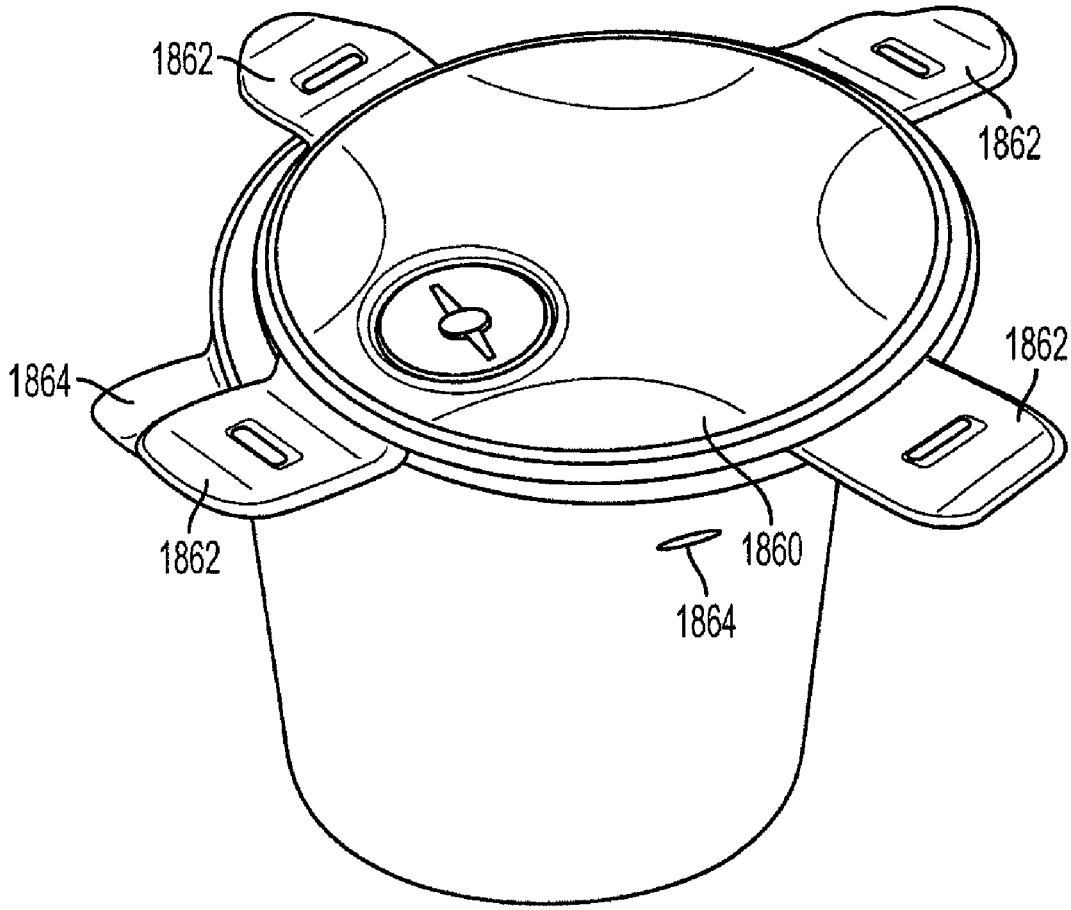
Figure 27C:
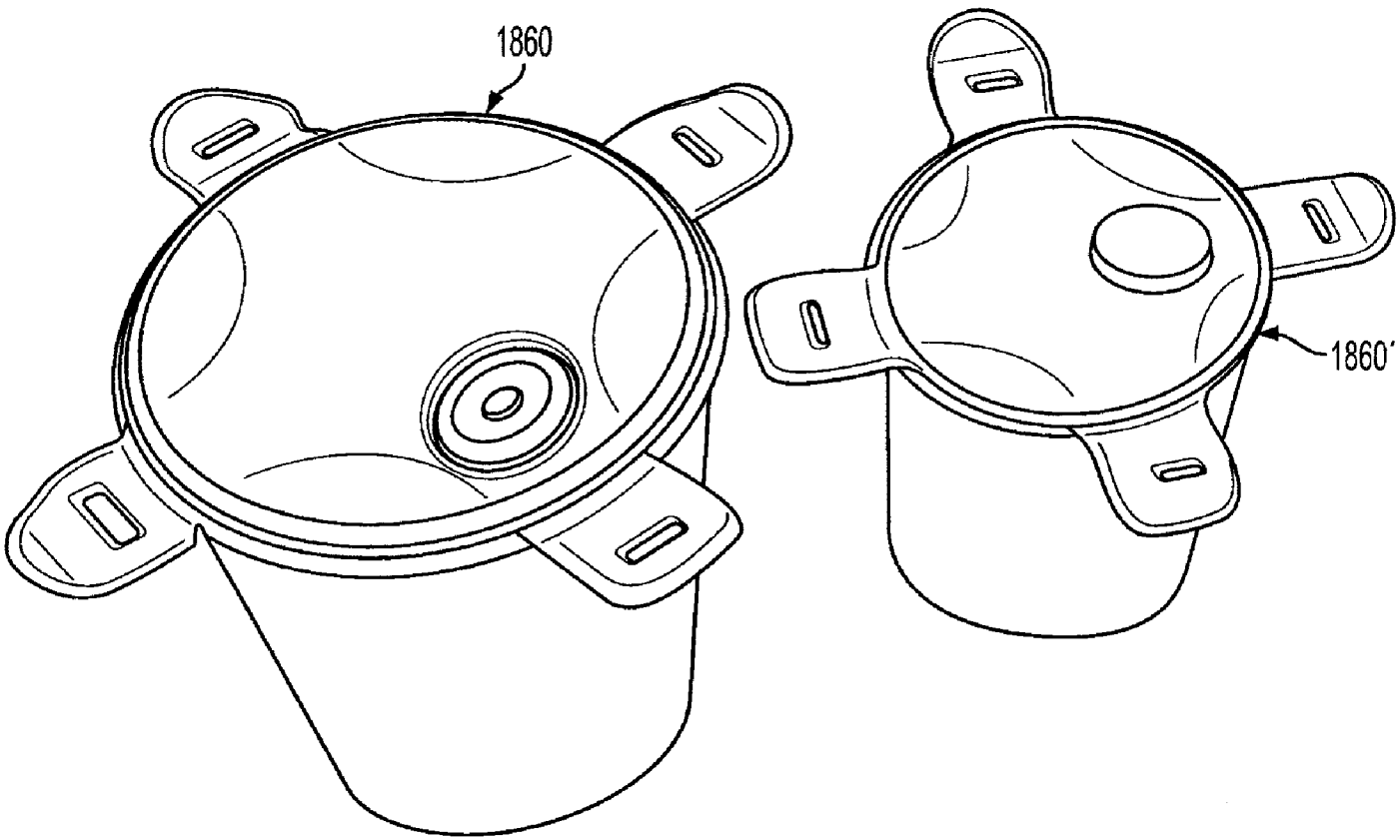

FIG. 27A-27C show a cover 1860 that can be received over a package, such as, for example, the package according to the third and eleventh embodiments. The cover 1860 includes hinged closure flaps 1862 spaced around the perimeter of the cover 1860. The closure flaps 1862 pivot downwardly about pivot or hinge portions 1864 to engage projections extending from the exterior of the receptacle to secure the cover 1860 to the receptacle. FIG. 27C also shows a smaller size container that can accommodate a smaller cover 1860'.

Figure 28A:
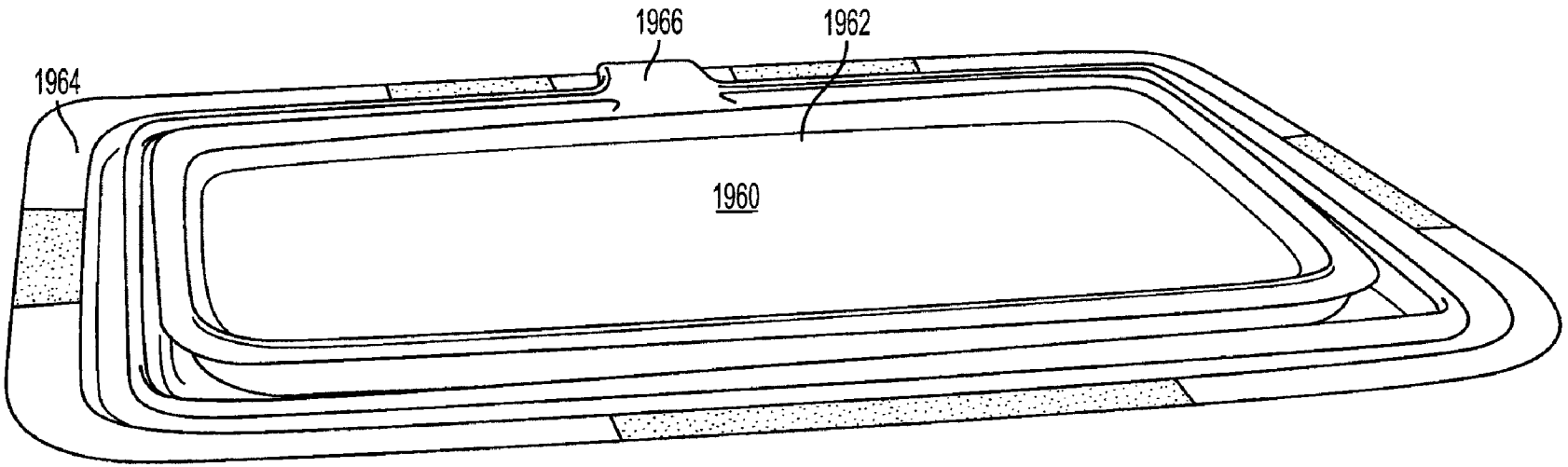
FIGS. 28A and 28B show a cover that can be received over a package, such as, for example, the package according to the third or eleventh embodiments.
Figure 28B:
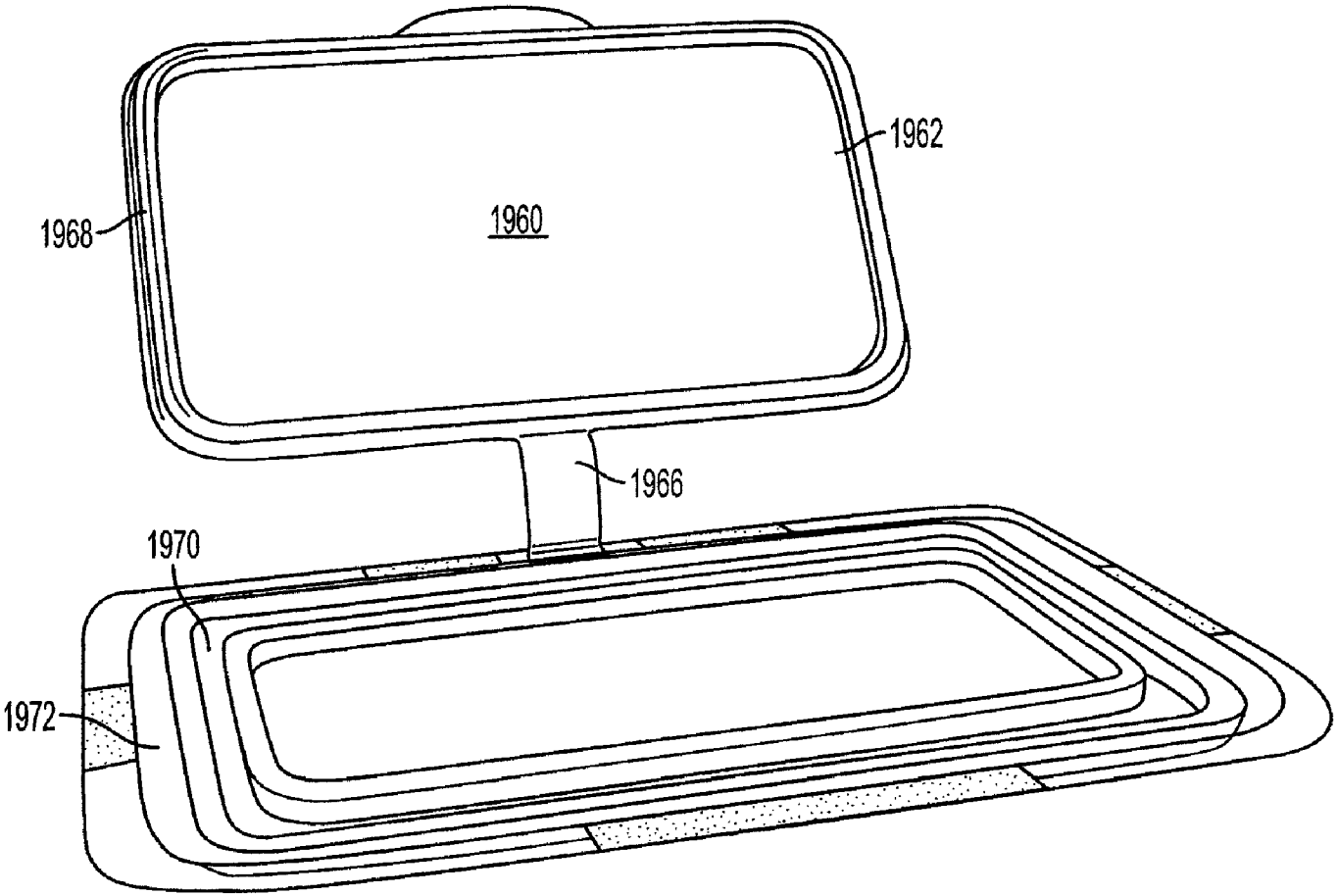

FIGS. 28A-28B show a cover 1960 that can be received over a package, such as, for example, the package according to the third and eleventh embodiments. The cover 1960 includes hinged portion 1962 connected to a base 1964 by a flexible hinge 1966. The hinged portion 1962 includes a downwardly projecting rim portion 1968 that engages a recess 1970 in the base 1964 to secure the hinged portion 1962 in a closed position. The base 1964 includes a downwardly projecting rim portion 1972 that engages an interior surface of the receptacle to secure the cover 1960 in place on the receptacle.

Figure 29A:
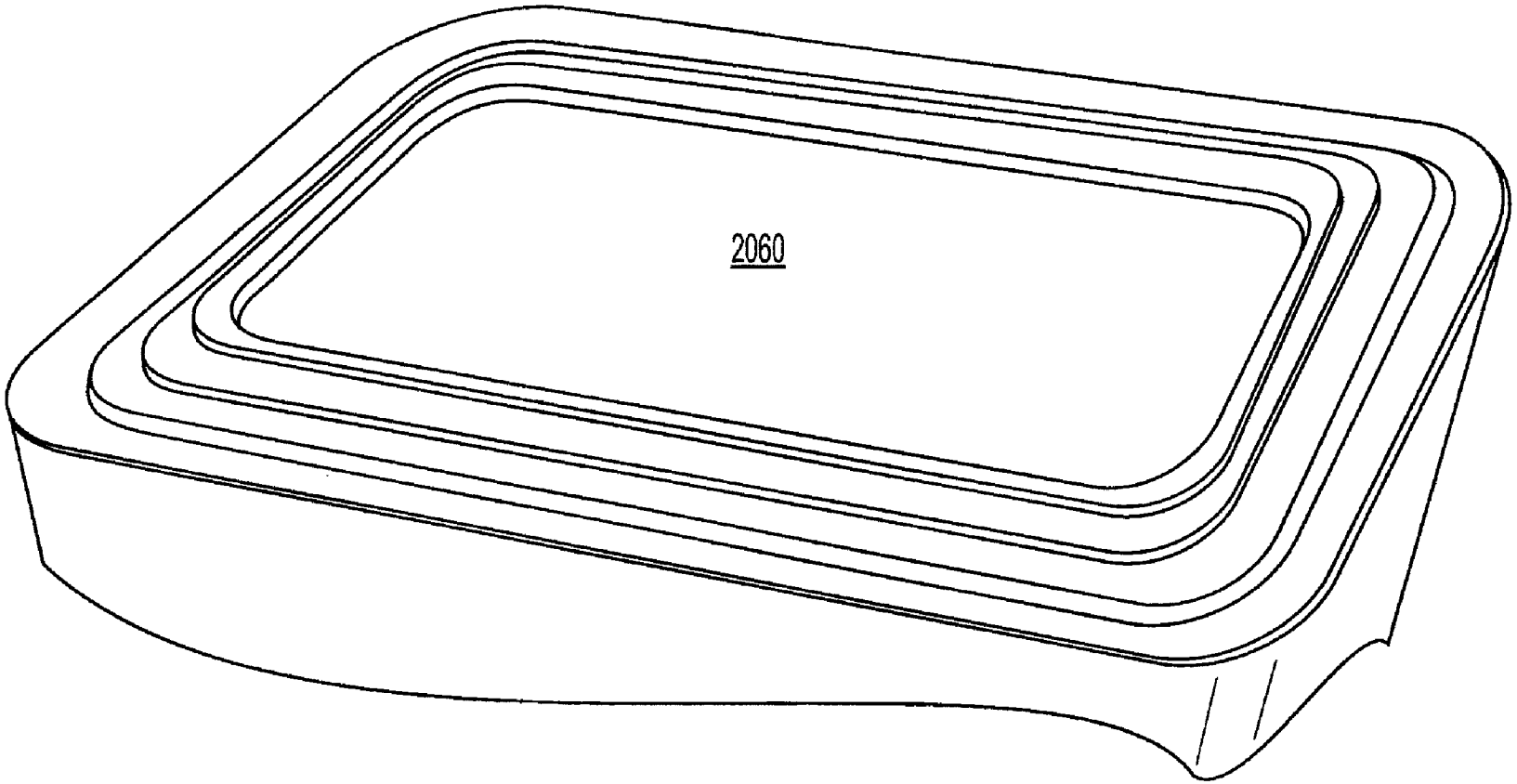
FIGS. 29A and 29B show a cover that can be received over a package, such as, for example, the package according to the third or eleventh embodiments.
Figure 29B:
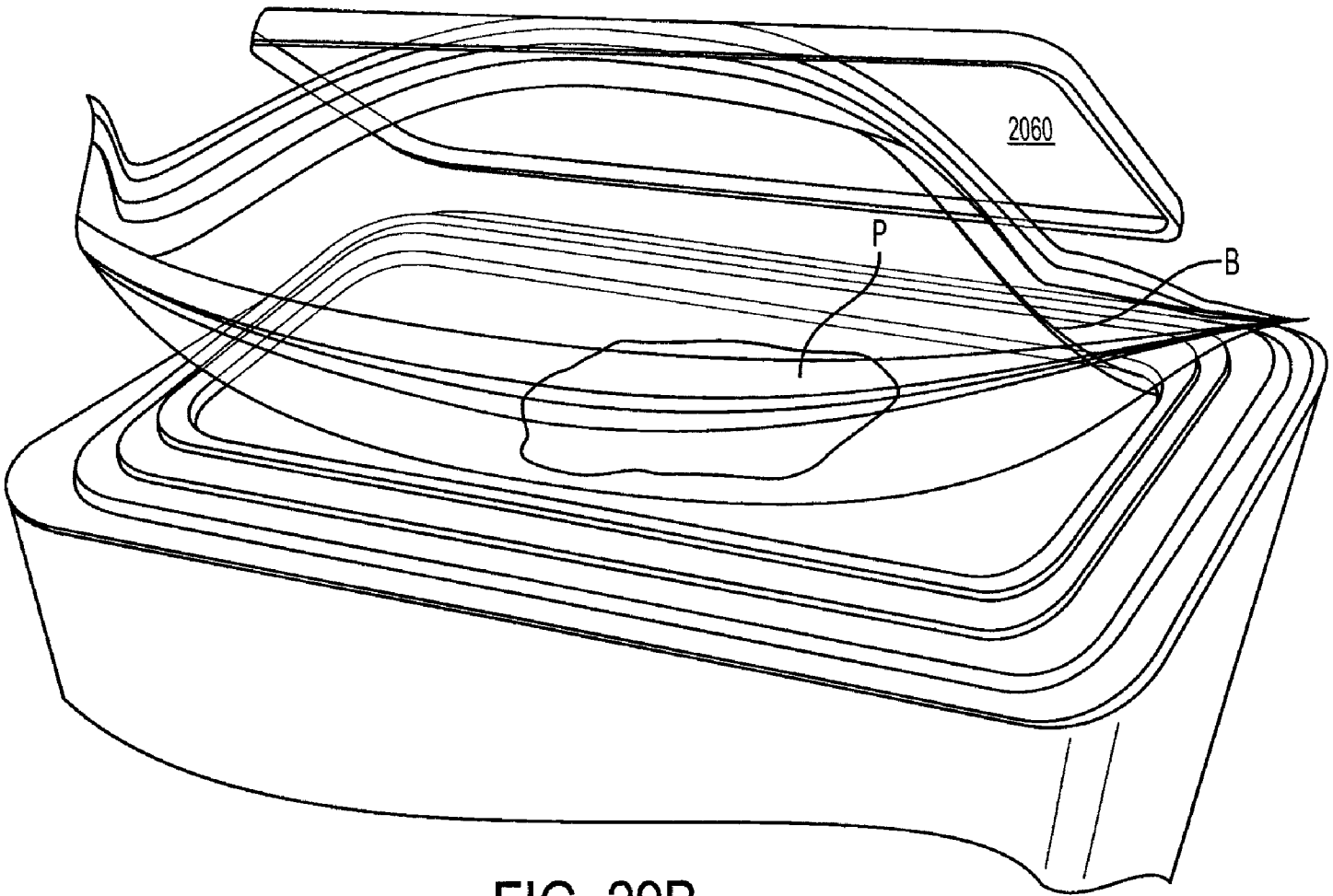

FIGS. 29A-29B a show a cover 2060 that can be received over a package, such as, for example, the package according to the third and eleventh embodiments. The cover 2060 includes hinged portion connected to a base by a flexible hinge. The hinged portion includes a downwardly projecting rim portion that engages a recess in the base to secure the hinged portion in a closed position. The base includes a downwardly projecting rim portion that engages an interior surface of the receptacle to secure the cover in place on the receptacle. As shown in FIG. 29B, the cover 2060 can be hinged to expose a flexible, resealable bag B filled with product P in the receptacle.

In the exemplary embodiments discussed above, the cartons, packages, etc. may be formed from blanks of, for example, paperboard, clay coated newsprint (CCN), solid unbleached sulfate (SUS) board. The blanks can also be constructed of other materials, such as cardboard, or any other material having properties suitable for enabling the cartons, packages, etc. to function at least generally as described above. The liquid or moisture-impervious materials used to form the barrier films and/or seals discussed in this specification can be formed from, for example, ComposiGard® or Integra Pak®, both of which are available from Graphic Packaging Corporation of Golden, Colo. Other suitable materials include ethylene vinyl alcohol (EVOH), ethylene vinyl acetate (EVA), polyethylene (PET), polyvinyl dichlorides (e.g., SARAN®), and foils. Other materials could also be used for the barrier films. Any of the cartons, packages, etc. discussed in this specification may include a barrier film. The above embodiments may be described as having one or more panels adhered together by glue. The term "glue" is intended to encompass all manner of adhesives commonly used to secure paperboard carton panels in place. Further, the covers can be made from materials such as plastics, for example, such as polypropylene, polyethylene, polyethylene terephthalate, nylon, etc., by injection molding, thermoforming, or die cutting, etc.

The term "line" as used herein includes not only straight lines, but also other types of lines such as curved, curvilinear or angularly displaced lines. In accordance with the exemplary embodiments, a fold line or hinge line can be any substantially linear, although not necessarily straight, form of weakening that facilitates folding therealong. More specifically, but not for the purpose of narrowing the scope of the present invention, fold lines include: score lines, such as lines formed with a blunt scoring knife, or the like, which creates a crushed or depressed portion in the material along the desired line of weakness; cuts that extend partially into a material along a desired line of weakness, and/or a series of cuts that extend partially into and/or completely through the material along the desired line of weakness; and various combinations of these features.

The blanks also can be laminated to or coated with one or more additional sheet-like materials at selected panels or panel sections. One or more panels of the blanks discussed above can be coated with varnish, clay, or other materials, either alone or in combination. The coating may then be printed over with product, advertising, and other information or images. The blanks may also be coated to protect information printed on the blanks. The blanks may be coated with, for example, a moisture barrier layer, on either or both sides of the blanks.

In the present specification, a "panel" or "flap" need not be flat or otherwise planar. A "panel" or "flap" can, for example, comprise a plurality of interconnected generally flat or planar sections.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed. For example, embodiments of the invention have been described as having several features included in combination, whereas each of these features may be included in a carton in isolation and in various combinations.

What is claimed is:

1. A carton with a moisture barrier, the carton comprising:

a top end and a bottom end;

a first side panel connected along a first longitudinal fold line to a second side panel, the second side panel connected along a second longitudinal fold line to a third side panel, the third side panel connected along a third longitudinal fold line to a fourth side panel;

a first oblique fold line in the first side panel, a second oblique fold line in the second side panel, the first and second oblique fold lines extending obliquely along the first longitudinal fold line, the first and second oblique fold lines extending obliquely from proximate the first longitudinal fold line to proximate the top end of the carton, and the first and second oblique fold lines extending divergently with respect to one another in a direction toward the top end of the carton;

a first side end panel connected along a lower transverse fold line of the first side panel, a second side end panel connected along a lower transverse fold line of the second side panel, a third side end panel connected along a lower transverse fold line of the third side panel, a fourth side end panel connected along a lower transverse fold line of the fourth side panel, the first, second, third and fourth side end panels being positioned at the bottom end of the carton; and a moisture resistant film adhered to an interior face of at least either the first side panel, second side panel, third side panel, or fourth side panel, but not adhered to the first end panel, the second end panel, the third end panel, or the fourth end panel;

wherein the carton is sized to receive a removable lid at its top end.

2. The carton of claim 1 wherein the top end of the carton is open, and the film extends through the open top end of the carton and beyond the open top end of the carton.

3. The carton of claim 1 wherein the film is sealed along the top of the carton to form a seal capable of being punctured.

4. The carton of claim 3 wherein the lid has an open portion and a closed portion and wherein at least a first portion of the seal is covered by the closed portion of the lid in a closed configuration and the first portion of the seal is exposed by the open portion of the lid in an open configuration.

5. The carton of claim 1 wherein the lid has a closed portion and a portion capable of being hinged to create an opening in the carton.

6. The carton of claim 5 wherein the opening is formed in a corner of the carton.

7. The carton of claim 6 wherein the portion capable of being hinged is formed in a triangular configuration.

8. The carton of claim 5 wherein the opening is formed entirely in either the first side panel, the second side panel, the third side panel, or the fourth side panel.

9. The carton of claim 8 wherein the lid is formed in a circular configuration.

10. The carton of claim 5 wherein the lid covers the top end of the carton and the hinged portion is disposed entirely within the lid.

11. The carton of claim 10 wherein the lid is formed in a rectangular configuration.

12. The carton of claim 10 wherein the lid is formed in a circular configuration.

13. The carton of claim 5 wherein the opening is formed in at least two of the first side panel, the second side panel, the third side panel, and the fourth side panel.

14. The carton of claim 13 wherein the lid is formed in an L-shaped configuration.

15. The carton of claim 5 wherein the lid covers the top end of the carton and includes hinged closure flaps capable of engaging projections on the carton.

16. The carton of claim 15 including a bag disposed in the carton beneath the lid.

17. The carton of claim 1 wherein the first and second oblique fold lines extend convergently with respect to one another toward a midportion of the first longitudinal fold line.

18. The carton of claim 17 further comprising:

a third oblique fold line in the second side panel, a fourth oblique fold line in the third side panel, the third and fourth oblique fold lines extending obliquely along the second longitudinal fold line, the third and fourth oblique fold lines extending obliquely from proximate the second longitudinal fold line to proximate the top end of the carton, the third and fourth oblique fold lines extending divergently with respect to one another in a direction toward the top end of the carton, and the first and second oblique fold lines extending convergently with respect to one another toward a midportion of the second longitudinal fold line; and a fifth oblique fold line in the third side panel, a sixth oblique fold line in the fourth side panel, the fifth and sixth oblique fold lines extending obliquely along the third longitudinal fold line, the fifth and sixth oblique fold lines extending obliquely from proximate the third longitudinal fold line to proximate the top end of the carton, the fifth and sixth oblique fold lines extending divergently with respect to one another in a direction toward the top end of the carton, and the fifth and sixth oblique fold lines extending convergently with respect to one another toward a midportion of the third longitudinal fold line.

19. The carton of claim 1 wherein the top end of the carton comprises a rolled rim.

20. The carton of claim 1 wherein the lower transverse fold line of the first side panel, the lower transverse fold line of the second side panel, the lower transverse fold line of the third side panel, and the lower transverse fold line of the fourth side panel are collinear with one another.

21. A package comprising:

a carton comprising a top end and a bottom end a first side panel connected along a first longitudinal fold line to a second side panel, the second side panel connected along a second longitudinal fold line to a third side panel, the third side panel connected along a third longitudinal fold line to a fourth side panel, a first oblique fold line in the first side panel, a second oblique fold line in the second side panel, the first and second oblique fold lines extending obliquely along the first longitudinal fold line, the first and second oblique fold lines extending obliquely from proximate the first longitudinal fold line to proximate the top end of the carton, and the first and second oblique fold lines extending divergently with respect to one another in a direction toward the top end of the carton;

a first side end panel connected along a lower transverse fold line of the first side panel, a second side end panel connected along a lower transverse fold line of the second side panel, a third side end panel connected along a lower transverse fold line of the third side panel, and a fourth side end panel connected along a lower transverse fold line of the fourth side panel, the first, second, third and fourth side end panels being positioned at the bottom end of the carton;

a moisture resistant film adhered to an interior face of at least either the first side panel, second side panel, third side panel, or fourth side panel, but not adhered to the first end panel, the second end panel, the third end panel, or the fourth end panel;

a removable lid attached to the top end of the carton; and a product disposed within the film in the carton.

22. The package of claim 21 wherein the top end of the carton is open, and the film extends through the open top end of the carton and beyond the open top end of the carton.

23. The package of claim 22 wherein the film is folded to enclose the product in the film.

24. The package of claim 22 wherein the film is rolled to enclose the product in the film.

25. The package of claim 21 wherein the film is sealed along the top of the carton to form a seal capable of being punctured.

26. The package of claim 25 wherein the lid has an open portion and a closed portion and wherein at least a first portion of the seal is covered by the closed portion of the lid in a closed configuration and the first portion of the seal is exposed by the open portion of the lid in an open configuration.

27. The package of claim 21 wherein the lid has an open portion and a closed portion and wherein at least a first portion of the seal is covered by the closed portion of the lid in a closed configuration and the first portion of the seal is exposed by the open portion of the lid in an open configuration.

28. The package of claim 21 wherein the lid has a closed portion and a portion capable of being hinged to create an opening in the package.

29. The package of claim 28 wherein the opening is formed in a corner of the package.

30. The package of claim 29 wherein the portion capable of being hinged is formed in a triangular configuration.

31. The package of claim 28 wherein the opening is formed entirely in either the first side panel, the second side panel, the third side panel, or the fourth side panel.

32. The package of claim 31 wherein the lid is formed in a circular configuration.

33. The package of claim 28 wherein the lid covers the top end of the carton and the hinged portion is disposed entirely within the lid.

34. The package of claim 33 wherein the lid is formed in a rectangular configuration.

35. The package of claim 33 wherein the lid is formed in a circular configuration.

36. The package of claim 28 wherein the opening is formed in at least two of the first side panel, the second side panel, the third side panel, and the fourth side panel.

37. The package of claim 36 wherein the lid is formed in an L-shaped configuration.

38. The package of claim 28 wherein the lid covers the top end of the package and includes hinged closure flaps capable of engaging projections on the package.

39. The package of claim 38 wherein the lid is formed in a rectangular configuration.

40. The package of claim 38 wherein the lid is formed in a circular configuration.

41. The package of claim 38 including a bag disposed in the package beneath the lid.

42. The package of claim 21 wherein the first and second oblique fold lines extend convergently with respect to one another toward a midportion of the first longitudinal fold line.

43. The package of claim 42 further comprising:

a third oblique fold line in the second side panel, a fourth oblique fold line in the third side panel, the third and fourth oblique fold lines extending obliquely along the second longitudinal fold line, the third and fourth oblique fold lines extending obliquely from proximate the second longitudinal fold line to proximate the top end of the carton, the third and fourth oblique fold lines extending divergently with respect to one another in a direction toward the top end of the carton, and the first and second oblique fold lines extending convergently with respect to one another toward a midportion of the second longitudinal fold line; and a fifth oblique fold line in the third side panel, a sixth oblique fold line in the fourth side panel, the fifth and sixth oblique fold lines extending obliquely along the third longitudinal fold line, the fifth and sixth oblique fold lines extending obliquely from proximate the third longitudinal fold line to proximate the top end of the carton, the fifth and sixth oblique fold lines extending divergently with respect to one another in a direction toward the top end of the carton, and the fifth and sixth oblique fold lines extending convergently with respect to one another toward a midportion of the third longitudinal fold line.

44. The package of claim 21 wherein the top end of the carton comprises a rolled rim.

45. A blank for forming a carton, the blank comprising:

a top end and a bottom end, and a front face and a back face;

a first side panel connected along a first longitudinal fold line to a second side panel, the second side panel, connected along a second longitudinal fold line to a third side panel, the third side panel connected along a third longitudinal fold line to a fourth side panel;

a first oblique fold line in the first side panel, a second oblique fold line in the second side panel, the first and second oblique fold lines extending obliquely along the first longitudinal fold line, the first and second oblique fold lines extending obliquely from proximate the first longitudinal fold line to proximate the top end of the blank, and the first and second oblique fold lines extending divergently with respect to one another in a direction toward the top end of the blank;

a first side end panel connected along a lower transverse fold line to the first side panel;

a second side end panel connected along the lower transverse fold line to the second side panel;

a third side end panel connected along the lower transverse fold line to the third side panel;

a fourth side end panel connected along the lower transverse fold line to the fourth side panel; and a film adhered to the back face along at least either the first side panel, second side panel, third side panel, or fourth side panel of the blank, but not adhered to the first end panel, the second end panel, the third end panel, or the fourth end panel;

wherein the film extends across and beyond the top end of the blank.

46. The blank of claim 45 wherein an adhesive panel is attached along a fourth longitudinal fold line to the fourth side panel.

47. The blank of claim 46 wherein a fifth side end panel is connected along the lower transverse fold line to the bottom end of the adhesive panel.

48. The blank of claim 47 comprising adhesive mounted to the blank along the adhesive panel and portions of at least either the first side end panel, the second side end panel, the third side end panel, the fourth side end panel, or the fifth side end panel.

49. The blank of claim 45 wherein the first and second oblique fold lines extend convergently with respect to one another toward a midportion of the first longitudinal fold line.

50. The blank of claim 49 further comprising:

a third oblique fold line in the second side panel, a fourth oblique fold line in the third side panel, the third and fourth oblique fold lines extending obliquely along the second longitudinal fold line, the third and fourth oblique fold lines extending obliquely from proximate the second longitudinal fold line to proximate the top end of the carton, the third and fourth oblique fold lines extending divergently with respect to one another in a direction toward the top end of the carton, and the first and second oblique fold lines extending convergently with respect to one another toward a midportion of the second longitudinal fold line; and a fifth oblique fold line in the third side panel, a sixth oblique fold line in the fourth side panel, the fifth and sixth oblique fold lines extending obliquely along the third longitudinal fold line, the fifth and sixth oblique fold lines extending obliquely from proximate the third longitudinal fold line to proximate the top end of the carton, the fifth and sixth oblique fold lines extending divergently with respect to one another in a direction toward the top end of the carton, and the fifth and sixth oblique fold lines extending convergently with respect to one another toward a midportion of the third longitudinal fold line.

* * * * *